US005899035A

United States Patent [19]

Waalkes et al.

[11] Patent Number: 5,899,035

[45] Date of Patent: May 4, 1999

[54] KNOCK-DOWN PORTABLE PARTITION SYSTEM

[75] Inventors: Michael L. Waalkes, Athens, Ala.; Mark T. Slager, Kentwood, Mich.; Brian Joseph Kane, San Francisco, Calif.; Marcus K. Pressnell, Athens, Ala.; Michael Robert Shields, Greensboro, N.C.; Robin Christopher, Athens, Ala.; Dennis J. Boyle, Palo Alto, Calif.; Charles A. Seiber, Atherton, Calif.; Peter N. Skillman, San Carlos, Calif.; Joseph Chang, Grand Rapids, Mich.

[73] Assignee: Steelcase, Inc., Grand Rapids, Mich.

[21] Appl. No.: 08/856,995

[22] Filed: May 15, 1997

[51] Int. Cl.[6] ..... E04B 2/74

[52] U.S. Cl. ..... 52/239; 52/36.1; 52/36.6; 52/571; 211/192; 248/222.13; 248/285.11; 248/245

[58] Field of Search ..... 52/220.7, 36.1, 52/36.6, 239, 511; 211/192; 248/222.13, 225.11, 245

[56] References Cited

U.S. PATENT DOCUMENTS

| | | |
|---|---|---|
| 3,209,869 | 10/1965 | Hammitt . |
| 3,601,432 | 8/1971 | Fenwick et al. . |
| 3,697,034 | 10/1972 | Shell . |
| 3,745,732 | 7/1973 | Pritchard et al. . |
| 3,749,432 | 7/1973 | Janssen . |
| 3,858,988 | 1/1975 | Cohen . |
| 3,888,440 | 6/1975 | Rebentisch . |
| 4,004,856 | 1/1977 | Wesseler . |
| 4,128,979 | 12/1978 | Price . |
| 4,154,419 | 5/1979 | Breidenbach . |
| 4,205,815 | 6/1980 | Sauer et al. . |
| 4,224,769 | 5/1990 | Ball et al. . |
| 4,334,374 | 6/1982 | Spamer et al. . |
| 4,391,073 | 7/1983 | Mollenkopf et al. . |
| 4,485,597 | 12/1984 | Worrallo . |
| 4,489,530 | 12/1984 | Chang . |
| 4,535,577 | 8/1985 | Tenser et al. . |
| 4,567,698 | 2/1986 | Morrison . |
| 4,571,906 | 2/1986 | Ashton . |
| 4,625,477 | 12/1986 | Johnstonbaugh . |

(List continued on next page.)

*Primary Examiner*—Christopher Kent
*Attorney, Agent, or Firm*—Price, Heneveld, Cooper, DeWitt & Litton

[57] ABSTRACT

A knock-down portable partition includes a panel frame having a central portion. The partition includes at least one cover panel covering at least a portion of the central portion of the panel frame. Connectors detachably mount the cover panel on the panel frame to facilitate assembly and removal of the cover panel on the panel frame. The panel frame includes at least two vertical posts having an upper end, a lower end, and opposite side faces. The opposite faces have at least two beam connection ports thereon positioned adjacent the upper and lower ends of the associated one of the posts. The panel frame also includes upper and lower beams extending generally horizontally between the vertical posts adjacent the upper and lower ends thereof. The upper and lower beams interconnect the vertical posts adjacent the connection ports. The panel frame includes quick-disconnect connectors such as movable lock wedges positioned on one of the posts and the beams adjacent the connection ports. The movable lock wedges are movably mounted for shifting between a retracted unlocked position and an extended locked position. The panel frame further includes wedge-engaging surfaces positioned on the other of the posts and the beams adjacent the connection ports. The wedge-engaging surfaces are located thereon to engage the wedges in a tight interference fit that inelastically deforms the wedge engaging surfaces when the wedges are shifted to the extended locked position to rigidly yet detachably interconnect the posts and the beams for quick and complete assembly and disassembly of the knock-down portable partition.

52 Claims, 15 Drawing Sheets

U.S. PATENT DOCUMENTS 4,631,881 12/1986 Charman .
4,682,457 7/1987 Spencer .
4,685,255 8/1987 Kelley .
4,716,699 1/1988 Crossman et al. .
4,719,731 1/1988 Ravotti et al. .
4,757,657 7/1988 Mitchell et al. .
4,771,583 9/1988 Ball et al. .
4,778,487 10/1988 Chenel .
4,858,407 8/1989 Smolik .
4,876,835 10/1989 Kelley et al. .
4,914,873 4/1990 Newhouse .
4,914,878 4/1990 Tamaki et al. .
4,914,880 4/1990 Albertini .
4,918,879 4/1990 Bodurow et al. .
4,932,177 6/1990 Hinden .
4,936,066 6/1990 Rütache et al. .
4,942,713 7/1990 Jackson .
4,971,281 11/1990 Steinbeck .
4,991,365 2/1991 Jackson .
4,991,368 2/1991 Amstutz .
5,038,539 8/1991 Kelley et al. .
5,054,255 10/1991 Maninfior .
5,056,285 10/1991 Prascaroli et al. .
5,062,246 11/1991 Sykes .
5,063,715 11/1991 Goodman .
5,065,559 11/1991 Zegel et al. .
5,069,263 12/1991 Edwards .
5,134,826 8/1992 La Roche et al. .
5,155,960 10/1992 Shaanan .
5,172,530 12/1992 Fishel et al. .
5,177,917 1/1993 del Castillo et al. .
5,207,336 5/1993 Tyler .
5,211,502 5/1993 Upham-Hill .
5,219,406 6/1993 Raz .
5,241,796 9/1993 Hellwig et al. .
5,274,970 1/1994 Roberts .
5,277,005 1/1994 Hellwig et al. .
5,287,666 2/1994 Frascaroli et al. .
5,377,466 1/1995 Insalaco et al. .
5,406,760 4/1995 Edwards .
5,477,971 12/1995 Howard .
5,586,593 12/1996 Schwartz ..... 52/239 X
5,606,919 3/1997 Fox et al. .
5,642,593 7/1997 Shieh ..... 52/239

KNOCK-DOWN PORTABLE PARTITION SYSTEM

CROSS-REFERENCES TO RELATED APPLICATIONS

The present application is related to commonly assigned, co-pending U.S. patent application Ser. No. 08/914,664, filed Aug. 19, 1997, entitled KNOCK-DOWN PORTABLE PARTITION SYSTEM.

BACKGROUND OF THE INVENTION

The present invention relates to office partition panel systems, and in particular to a knock-down portable partition that has a unique post and beam construction configured for quick and easy on-site manual assembly.

The efficient use of building floor space is an ever growing concern, particularly as building costs continue to escalate. Open office plans have been developed to reduce overall officing costs, and generally incorporate large, open floor spaces in buildings that are equipped with modular furniture systems which are readily reconfigurable to accommodate the ever changing needs of a specific user, as well as the divergent requirements of different tenants. One arrangement commonly used for furnishing open plans includes movable or portable partition panels that are detachably interconnected to partition off the open spaces into individual workstations and/or offices. Such partition panels have sufficient structural strength to receive hang-on furniture units, such as work surfaces, overhead cabinets, shelves, etc., and are generally known in the office furniture industry as "systems furniture." In addition, such partition panels have an acoustical, sound-absorbing configuration to promote a quiet, pleasant work environment.

Numerous partition panel systems have been developed for dividing office workspaces into smaller areas. Partition panel systems, like those disclosed in U.S. Pat. No. 4,996,811, utilize prefabricated rectangular partition panel members that have a unitary rigid perimeter frame formed by top, bottom, and end channels that are welded to one another. Decorative cover panels are fastened to opposite sides of the perimeter frame. Each perimeter frame member has a rectangular shape, and is fabricated and shipped as a single unit, often with the decorative cover panels pre-fastened to the frame. During installation, the prefabricated perimeter frame of each panel member is fastened to the perimeter frame of an adjacent panel member along the vertical edges thereof, either directly, or by a separate fastener post. Each partition panel member includes two height adjustable feet or glides along the bottom edge of each panel member, with one glide being located adjacent each vertical panel edge. Since there are two vertical frame members at each panel joint, this type of panel construction results in structural redundancy. In addition, since each glide must be properly adjusted for height, this configuration requires adjustment of both glides at each panel joint during assembly. Furthermore, although longer panels typically have a lower cost per unit length, longer panels are difficult to handle, which places a practical limit on the size of the partition panel member that can be shipped and installed as a prefabricated unit.

Other partition panel systems, like that disclosed in U.S. Pat. No. 5,150,554, utilize prefabricated rectangular partition panel members having a unitary perimeter frame that attaches to a post member along each vertical panel edge. Although this type of design may have a single glide at each post, each panel-to-post connection has at least two vertical structural members. Since only a single vertical member is needed to provide support and height adjustment, this type of system has redundant structure. In addition, the rectangular partition panel members are manufactured and shipped as a unit, limiting the size of the partition panel members that can be used.

Other office divider systems, like that disclosed in U.S. Pat. No. 5,406,760, utilize vertical posts and horizontal beams wherein each post attaches to an adjacent post along adjacent vertical edges. Since each post is attached directly to an adjacent post, this configuration also has redundant vertical structural members and glides.

Other office panel dividers, like that disclosed in U.S. Pat. Nos. 5,287,666 and 5,219,406, have multiple posts and beams with connector members that hold a pair of beams to adjacent posts. This configuration has two horizontal beams in a side-by-side relationship at each height location, and also has two vertical posts attached directly together in either a back-to-back or side-by-side relationship. Thus, there is redundancy in both the post and the beam structures. In addition, connector pieces are required to attach the beams to the posts.

SUMMARY OF THE PRESENT INVENTION

One aspect of the present invention is a knock-down portable partition comprising a panel frame having a central portion. The partition includes at least one cover panel covering at least a portion of the central portion of the panel frame. Connectors detachably mount the cover panel on the panel frame to facilitate assembly and removal of the cover panel on the panel frame. The panel frame includes at least two vertical posts having an upper end, a lower end, and opposite side faces. The opposite faces have at least two beam connection ports thereon positioned adjacent the upper and lower ends of the associated one of the posts. The panel frame also includes upper and lower beams extending generally horizontally between the vertical posts adjacent the upper and lower ends thereof. The upper and lower beams interconnect the vertical posts adjacent the connection ports. The panel frame also has movable lock wedges positioned on one of the posts and the beams adjacent the connection ports. The movable lock wedges are movably mounted for shifting between a retracted unlocked position and an extended locked position. The panel frame further includes wedge-engaging surfaces positioned on the other of the posts and the beams adjacent the connection ports. The wedge-engaging surfaces are located thereon to engage the wedges in a tight interference fit when the wedges are shifted to the extended locked position to rigidly yet detachably interconnect the posts and the beams for quick and complete assembly and disassembly of the knock-down portable partition.

Another aspect of the present invention is in a portable partition system, the improvement of a knock-down frame construction comprising at least two vertical posts each having an upper end, a lower end, and opposite faces with at least two beam connection ports thereon positioned adjacent the upper and lower ends of the associated one of the posts. The frame construction includes upper and lower beams extending generally horizontally between the vertical posts adjacent the upper and lower ends thereof, and interconnecting the posts adjacent the connection ports. The frame construction also includes movable lock wedges positioned on one of the posts and the beams adjacent the connection ports, and being movably mounted thereon for shifting between a retracted unlocked position and an extended locked position. The frame construction further includes wedge-engaging surfaces positioned on the other of the posts and the beams adjacent the connection ports. The wedge-engaging surfaces are located thereon to engage the wedges in a tight interference fit when the wedges are shifted to the extended locked position to rigidly yet detachably interconnect the posts and the beams for quick and complete assembly and disassembly of the knock-down portable partition.

Yet another aspect of the present invention is a knock-down portable partition comprising at least two vertical posts, each having a plurality of utility trough ports with associated windows through the posts for passing utility conduits therethrough. The partition includes upper and lower beams having opposite ends thereof interconnecting the vertical posts adjacent upper and lower portions thereof to define when in an assembled condition, a rigid panel frame having a substantially open interior. The partition also includes at least one cover panel configured to enclose at least a portion of the open interior of the panel frame, and being removably mounted on the panel frame to readily access the open interior thereof. The partition further includes at least one utility trough shaped to receive and retain utility conduits therein, and having opposite ends thereof configured to be detachably connected with a horizontally aligned pair of the utility trough ports on the posts when said panel frame is in the assembled condition.

Yet another aspect of the present invention is a knock-down portable partition system comprising at least three vertical posts with upper and lower ends and vertical faces. The posts have sufficient structural strength to support hang-on accessory units thereon. The posts have a vertical row of slots extending along one of the vertical faces for hanging a hang-on accessory unit, and beam connection ports on another one of the vertical faces. The partition system also includes at least four beams extending generally horizontally between the posts adjacent the upper and lower ends thereof, and having opposite ends thereof rigidly connected to the beam connection ports to define when in an assembled condition, at least two adjacent rigid panel frames, each having a substantially open interior. The beams provide the primary structural interconnection between the posts. The partition system also includes at least one cover panel configured to enclose at least a portion of the interior of at least one of the panel frames. The cover panel is removably mounted on the one panel frame to readily access the open interior thereof. The partition system further includes a hang-on accessory unit removably attached to at least one of the vertical rows of slots of a selected one of the end posts.

Yet another aspect of the present invention is in a portable partition system, the improvement of a knock-down frame construction comprising at least two vertical posts each having an upper end, a lower end, and opposite side faces with at least two beam connection ports thereon positioned adjacent the upper and lower ends of the associated one of the posts. The frame construction includes upper and lower beams extending generally horizontally between the vertical posts adjacent the upper and lower ends thereof, and interconnecting the same adjacent the connection ports. The frame construction also includes quick-disconnect connectors positioned on the posts adjacent the connection ports. The frame construction further includes second quick-disconnect connectors positioned on the beams adjacent the connection ports, and being located thereon to engage the first quick-disconnect connectors to rigidly yet detachably interconnect the posts and the beams for quick and complete assembly and disassembly of the knock-down portable partition.

Yet another aspect of the present invention is in a portable partition system, the improvement of a quick-disconnect frame connection system comprising at least one post, and at least one beam. The frame connection system includes at least one connection port positioned between the post and the beam. At least one lock wedge is positioned on one of the posts and the beams adjacent the connection port, and is movably mounted thereon for shifting between a retracted unlocked position and an extended locked position. The frame connection system further includes at least one wedge-engaging surface position on the other of the posts and the beams adjacent the connection ports. The wedge is located thereon to be engaged and inelastically deformed by the wedge when the wedge is shifted to the extended locked position to create a tight interference fit which rigidly yet detachably interconnects the post and the beam.

The principal objects of the present invention are to provide a knock-down, portable partition system. Accordingly, the present partition provides a versatile, easily assembled and disassembled partition having reduced complexity and fewer components. The individual components are assembled at the installation site, thereby reducing shipping costs, and allowing for longer, more economical panel sizes. The partition panel is easily and quickly assembled, and does not require separate fasteners, such as conventional nuts and bolts. The partition panels have sufficient structural strength to support hang-on accessory units, such as binder bins, shelves, and work surfaces. Utility troughs may be installed at various heights between the posts to provide for electrical and communications conduits. The utility troughs may be installed or removed after the structural beams are installed between adjacent posts. Each post has a single adjustable foot, and a vertical row of slots for support of hang-on accessory units. Cover panels are installed to close off the open interior of the panel. Two adjacent cover panels are attached to a single post at each in-line panel joint.

These and other features, objects and advantages of the present invention will become apparent upon reading the following description thereof together with reference to the accompanying drawings.

DETAILED DESCRIPTION OF THE PREFERRED EMBODIMENTS

Figure 1:
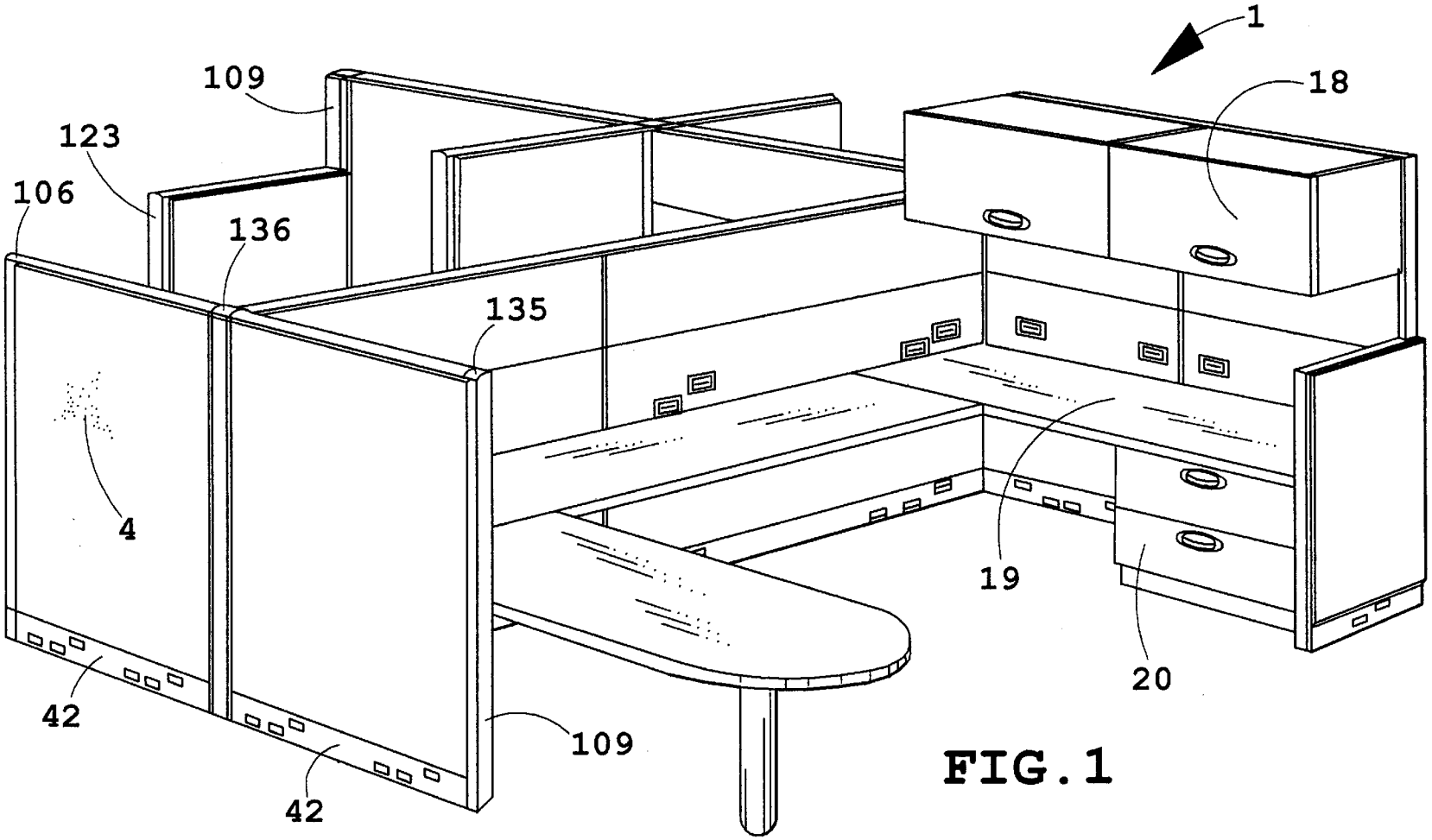
FIG. 1 is a perspective view of a knock-down partition system embodying the present invention comprising a post and beam construction which is covered by acoustic, decorative cover panels.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a knock-down portable partition system embodying the present invention. The illustrated knock-down portable partition system 1 has a panel frame 2 (FIGS. 2, 3) having a central portion 3 generally indicated by the reference numeral 3 in FIG. 3. At least one cover panel 4 covers at least a portion of the central portion 3 of the panel frame 2. Connectors 5 detachably mount the cover panel 4 on the panel frame 2 to facilitate assembly and removal of the cover panel 4 on the panel frame 2. The panel frame 2 includes at least two vertical junctions such as vertical posts 6 each having an upper end 7, a lower end 8, and opposite faces 9 with at least two beam connection ports 10 thereon positioned adjacent the upper and lower ends 7, 8 of the associated one of the posts 6. Upper and lower bars or beams 11 extend generally horizontally between the vertical posts 6 adjacent the upper and lower ends 7, 8 thereof, and interconnect the same adjacent the connection ports 10. Movable lock wedges 12 are positioned on one of the posts 6 and the beams 11 adjacent the connection ports 10, and are movably mounted thereon for shifting between a retracted unlocked position 13 and an extended locked position 14. As best seen in FIGS. 4 and 5, wedge-engaging surfaces 15 are positioned on the other of the posts 6 and the beams 11 adjacent the connection ports 10, and are located thereon to engage the wedges 12 in a tight interference fit when the wedges 12 are shifted to the extended locked position to rigidly yet detachably interconnect the posts 6 and the beams 11 for quick and complete assembly and disassembly of the knock-down portable partition 1.

Figure 4:
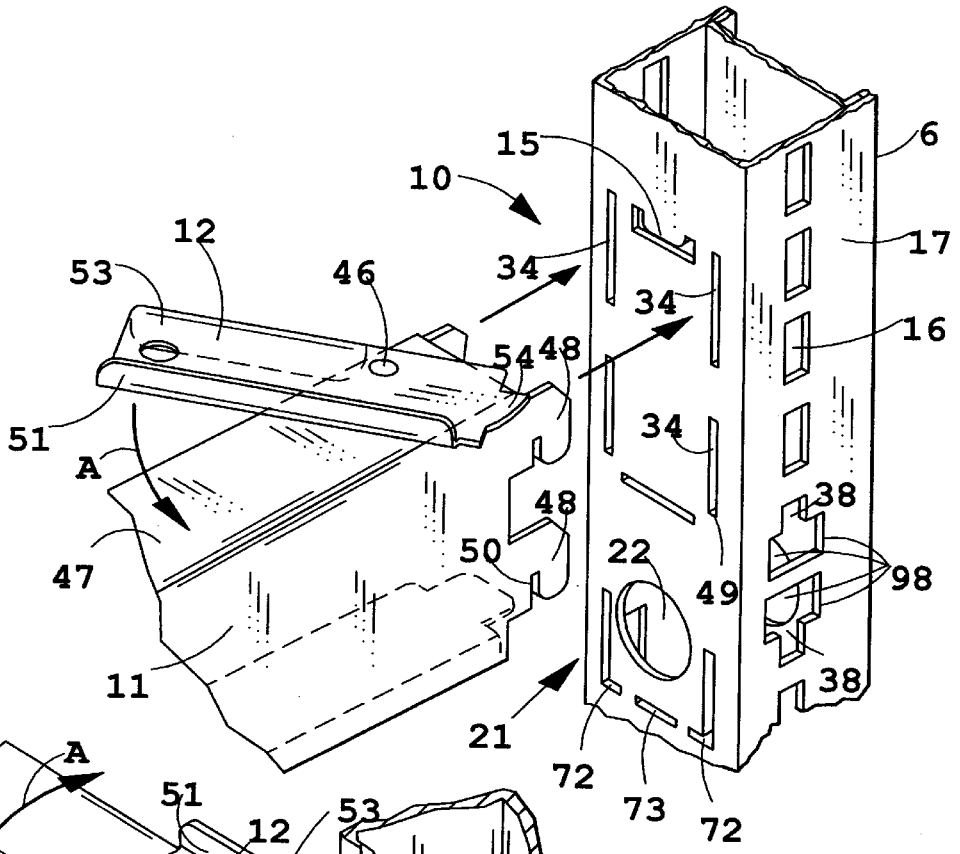
FIG. 4 is a fragmentary, perspective view of the wedge lock and beam connection port.
Figure 5:
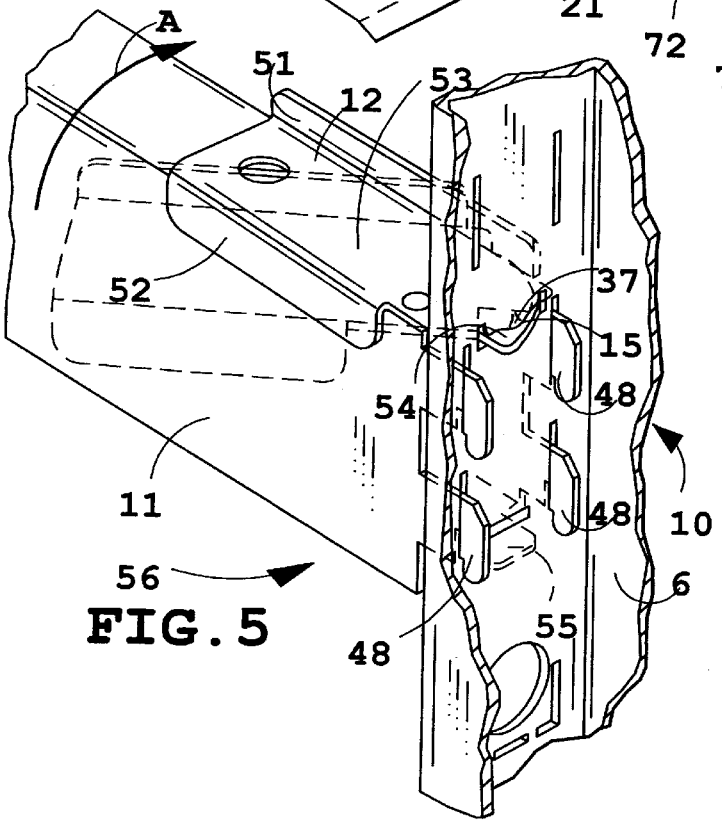
FIG. 5 is a fragmentary, perspective view of the lock wedge in the engaged position showing the inelastic deformation of the wedge-engaging surface.
Figure 6:
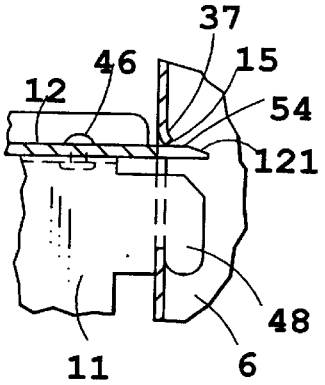
FIG. 6 is a fragmentary, front elevational view of the lock wedge in the engaged position showing the deformation of the wedge-engaging surface.
Figure 7:
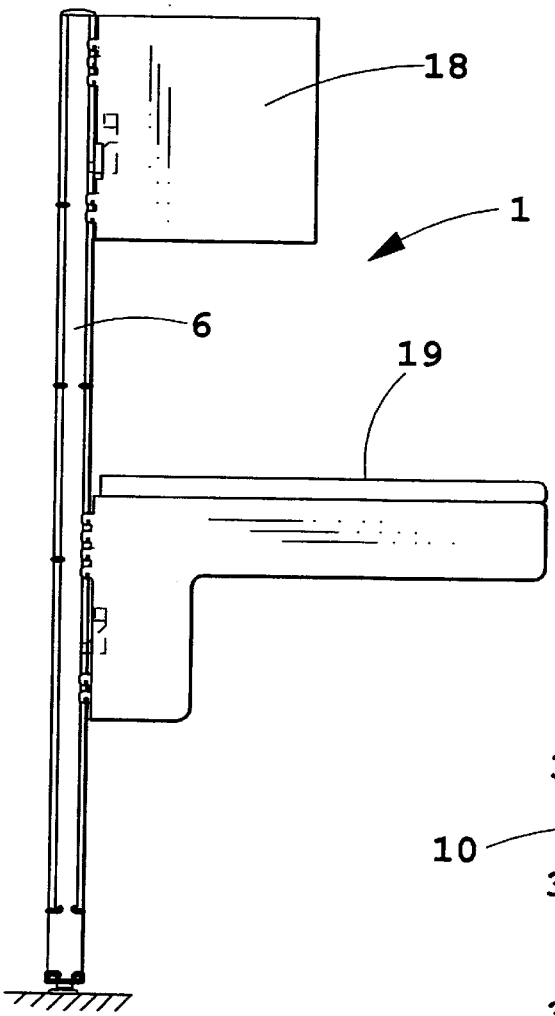
FIG. 7 is a partially schematic side elevational view of the partition system with hang-on bins and work surfaces installed.

In the illustrated example, the movable lock wedges 12 of the present invention form a quick-disconnect connector that engages and inelastically deforms the wedge-engaging surface 15 when the wedge 12 is shifted to the extended locked position 14 to create a tight interference fit which rigidly yet detachably interconnects the post 6 and the beam 11 (FIG. 5). In addition, each post 6 includes a vertical row of slots 16 extending along a vertical face 17. With reference to FIGS. 4 and 6, the vertical row of slots 16 provide for removably attaching a hang-on accessory unit such as a binder bin 18 or a work surface 19. A lower file storage unit 20 is also removably supported by the vertical row of slots 16 in the posts 6 (FIG. 1). Accordingly, the posts 6 each have sufficient structural strength to support the hang-on accessory units.

Figure 2:
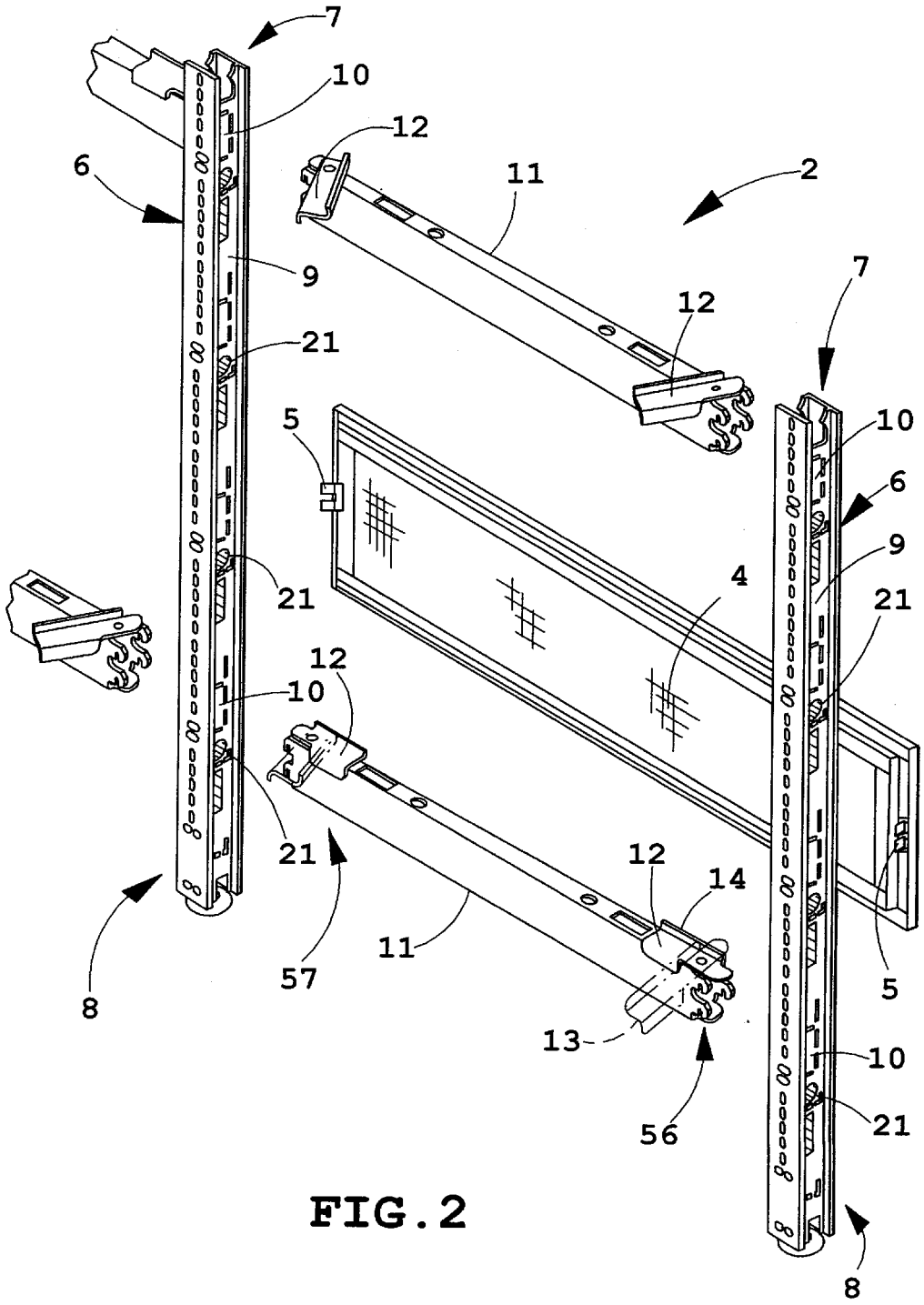
FIG. 2 is a fragmentary, exploded perspective view of the vertical posts, beams, and cover panels.
Figure 3:
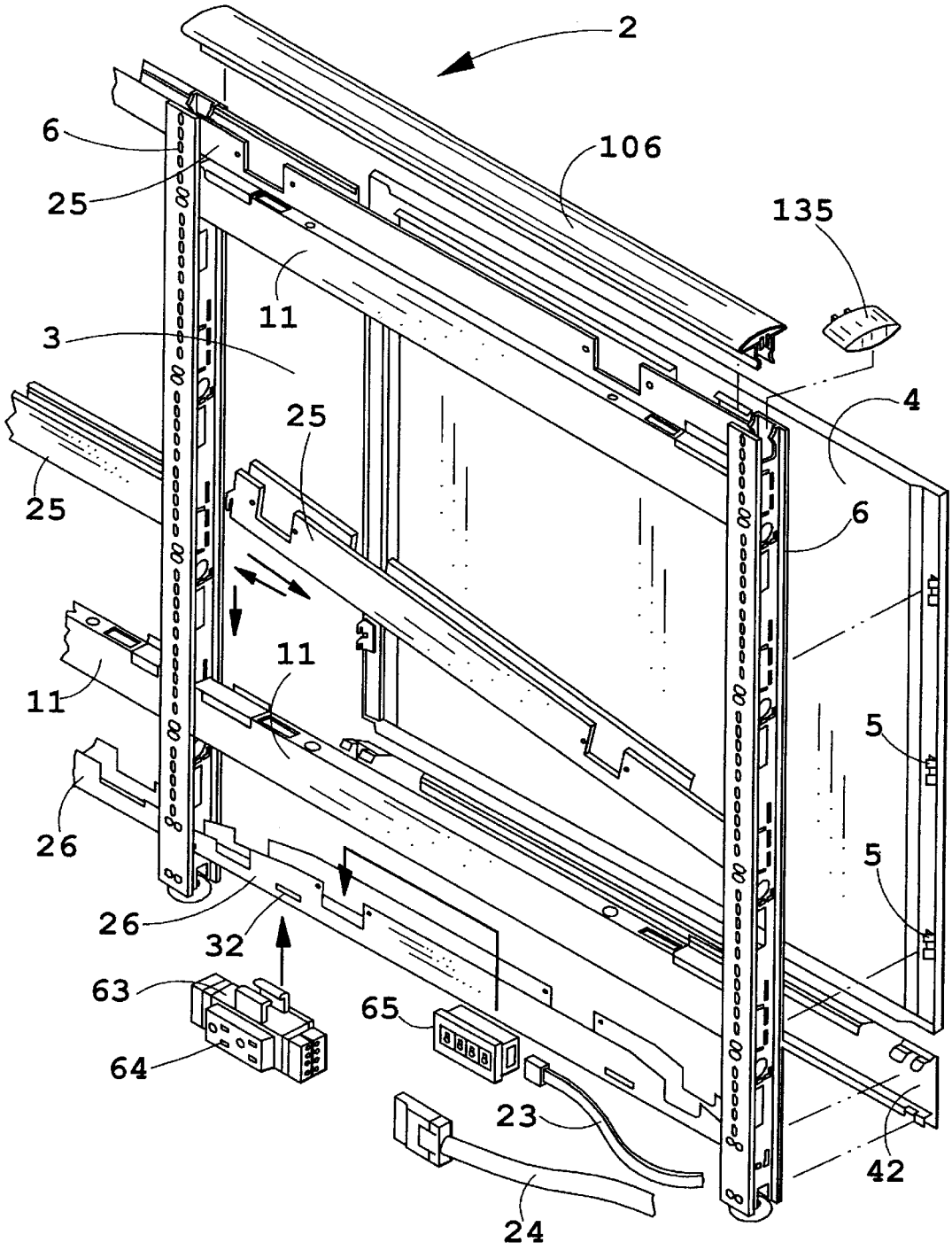
FIG. 3 is a fragmentary, exploded perspective view of the vertical posts, data and power troughs, beams and cover panels.

With reference to FIGS. 2–4, each of the vertical posts 6 include a plurality of utility trough ports 21 with associated windows 22 (FIG. 8) through the posts 6 for passing utility conduits such as data or communications lines 23 or power lines 24 therethrough (FIG. 3). The partition includes at least one utility trough such as data trough 25 or power trough 26 that are shaped to receive and retain utility conduits therein. The utility troughs have opposite ends thereof configured to be detachably connected with a horizontally aligned pair of utility trough ports 21 on the posts 6 when the panel frame 2 is in an assembled condition.

Figure 9:
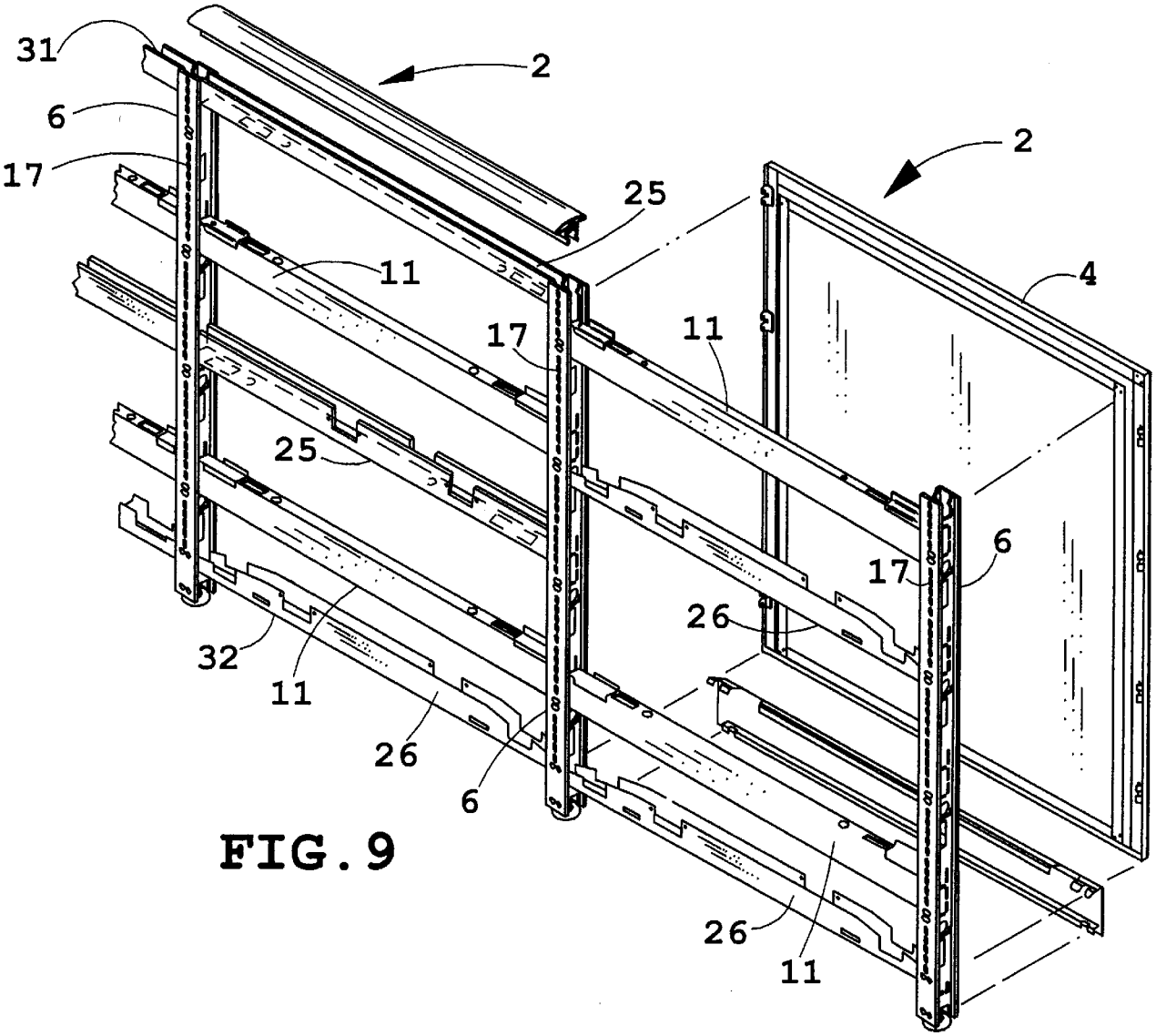
FIG. 9 is a fragmentary, perspective view of two adjacent panel frames showing an intermediate post with beams rigidly connected to both opposite side faces.
Figure 12:
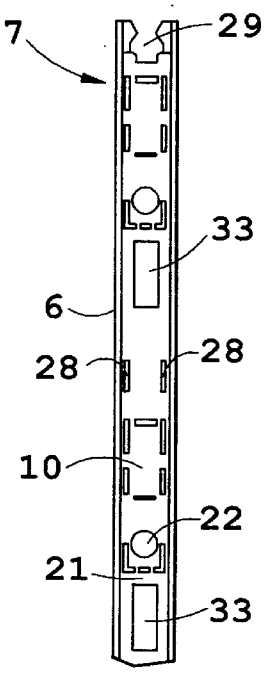
FIG. 12 is a top plan view of the vertical post.
Figure 12:
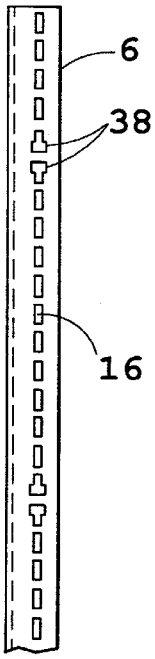
Figure 12:
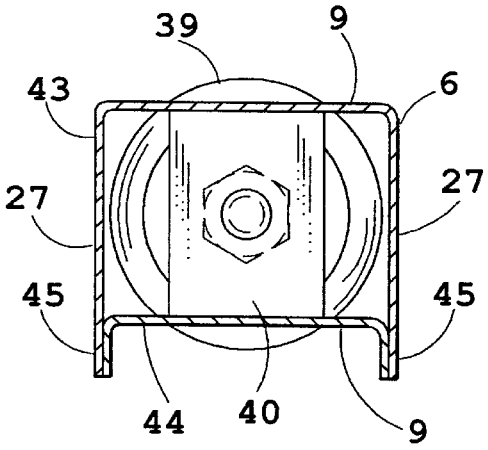
Figure 10:
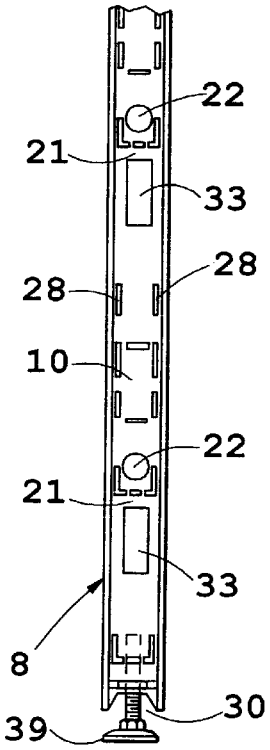
FIG. 10 is fragmentary, front elevational view of the vertical post.
Figure 11:
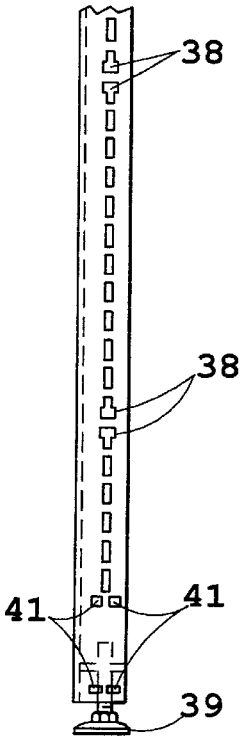
FIG. 11 is a fragmentary, side elevational view of the vertical post.
Figure 13:
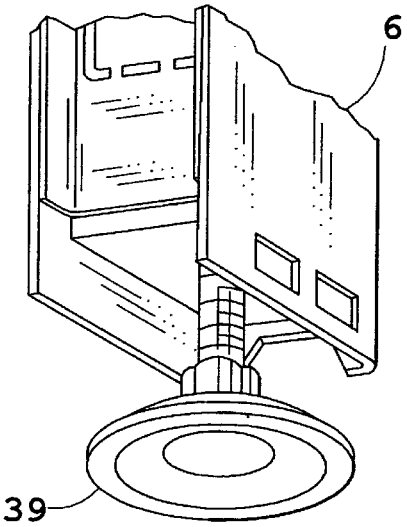
FIG. 13 is a fragmentary, perspective view of the bottom end of the vertical post showing the foot.

As best seen in FIG. 9, two adjacent rigid panel frames 2 are formed by three vertical posts 6 and at least four beams 11 extending generally horizontally between the posts 6 adjacent the upper and lower ends 7, 8 thereof. The beams 11 provide the primary structural interconnection between the posts 6, with the cover panels 4 providing acoustical and decorative functions.

Figure 8:
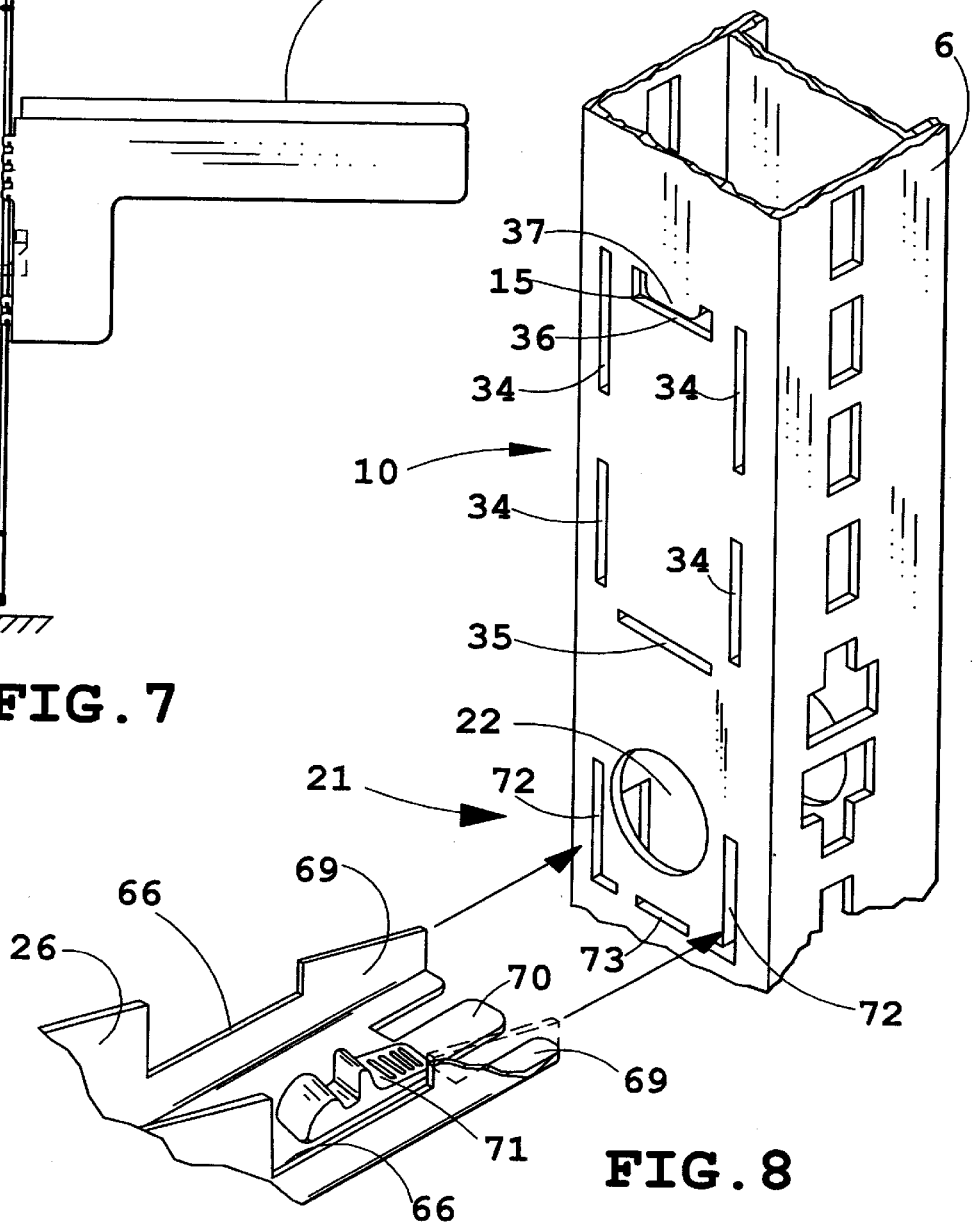
FIG. 8 is a fragmentary, perspective view of the utility trough port and a power trough with sliding wedge.

As shown in FIGS. 10–13, each vertical post 6 has a pair of opposite faces 9 and front faces 27. Each post 6 includes an upper utility trough port 29 having a window that is open along the upper side for lay-in of utility conduits such as data lines 23 along the top edge 31 of the panel frame 2. In addition, each post 6 has a utility trough port 21 adjacent the lower end, with a window 30 (FIG. 25) having an open lower edge for lay-in of utility conduits such as power lines 24 along the bottom edge 32 of the panel frame 2 (FIG. 3). Each of the utility trough ports 21 include a circular window 22 and a rectangular window 33. Data and power lines 23, 24 that are routed in the data or power troughs 25, 26 may be fed through the windows 22. If required, power box 63 may be snapped to the bottom of the power trough 26 (FIG. 3), and the power line 24 passed through the rectangular windows 33. As best seen in FIG. 8, each beam connection port 10 includes four vertical slots 34 and a horizontal slot 35. In addition, a pair of upper slots 28 (FIG. 10) are located directly above the beam connection ports 10 for connecting an upper utility trough of a shorter panel frame 2 at a change of height location. A small window 36 of the beam connection port 10 includes a downwardly extending tab 37 having a wedge-engaging surface 15 along the lower edge thereof. In addition, the front faces 27 of each post 6 include apertures 38 for mounting of the cover panels 4. Each of the posts 6 have a single, vertically adjustable foot 39 which is received in a threaded plate 40 that is welded to the lower end 8 of the post. The front face 27 also include four apertures 41 near the lower end 8 of each post for removably mounting a base cover 42. Each post 6 is made from a larger U-shaped piece 43 and a smaller U-shaped piece 44, each of which is formed from sheet metal. The larger and smaller U-shaped pieces 43 and 44 are welded together at the edge 45.

With reference to FIGS. 2–6, each beam 11 has a movable lock wedge 12 that is rotatably mounted to the upper side 47 of the beam 11 by a rivet 46. The beam 11 includes four tabs and slots that form downwardly extending hooks 48 at each end that are received in vertical slots 34 of the beam connection port 10. Each hook 48 forms a slot 50 that engages the bottom edge 49 of each vertical slot 34. The lock wedge 12 is formed from sheet metal, and includes a flat body portion 53 that forms a lever arm for mechanical advantage whereby the lock wedges 12 can be manually shifted from a retracted unlocked position to an extended locked position by a person without the use of tools. An upwardly turned flange 51 provides a surface for an installer to push against for manually rotating the locking wedge 12 out of the engaged position in a direction opposite the arrow "A" shown in FIGS. 4 and 5. Each locking wedge 12 also includes a downward flange 52 that provides a stop when the locking wedge 12 is rotated into the extended locked position shown in FIG. 5.

Shifting the locking wedge 12 to the extended locked position inelastically deforms the wedge-engaging surface 15 of the downwardly extending tab 37 due to the tight interference fit between the extension 54 of the locking wedge 12 and the wedge-engaging surface 15. The extension 54 is "coined," or flattened at 121 to facilitate engagement with the wedge engaging surface 15. In the illustrated example the wedge-engaging surface 15 is permanently or inelastically deformed; however, a tight interference fit that does not result in inelastic deformation may also be used lock the beam 11 to the post 6. Alternatively, the locking wedge 12 could have a tapered cam surface on the extension 54 to progressively engage the wedge-engaging surface 15 to form a tight interference fit. This interference fit may be chosen such that the wedge-engaging surface 15 is inelastically deformed in a similar manner to that shown in FIGS. 5 and 6.

Figure 15:
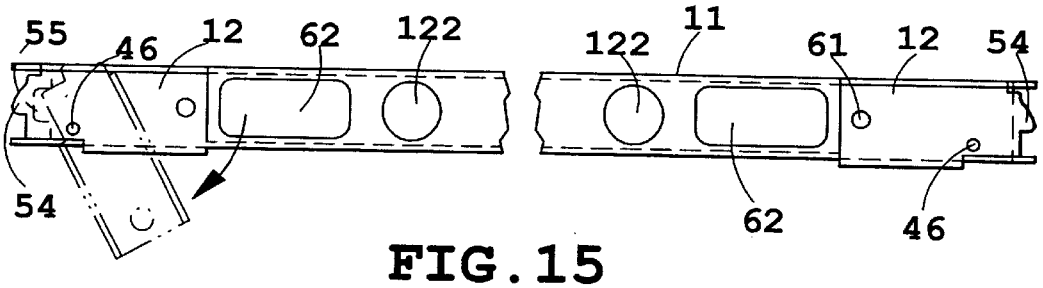
FIG. 15 is fragmentary, top plan view of the beam.
Figure 14:
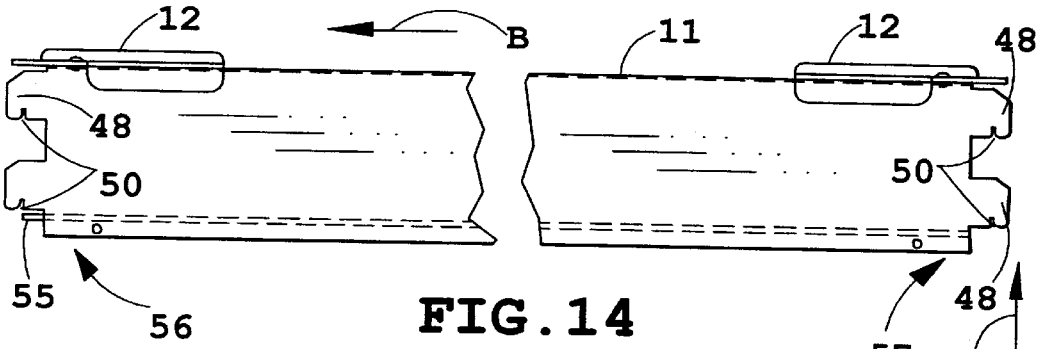
FIG. 14 is a fragmentary, side elevational view of the beam.
Figure 16:
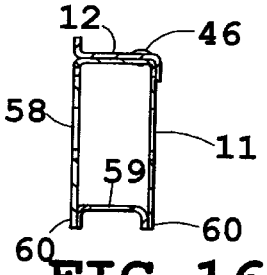
FIG. 16 is a side elevational view of the beam.

Each beam 11 is designed to be removed from between a pair of posts 6 that form assembled panel frames 2 adjacent the panel frame being disassembled in a manner similar to the data trough 25 illustrated in FIG. 3. This is accomplished by providing longer, extended hooks 48 at a first end 56 of the beam 11 (FIG. 14). In addition, a horizontal tab 55 is provided at the first end 56 (FIGS. 14–16). The beam 11 is removed by shifting it in the direction of the arrow "B" (FIG. 14) and then raising the second end 57 in the direction of the arrow "C" and the sliding the beam 11 in a direction opposite the arrow B. The horizontal tab 55 provides stability and guides the first end 56 of the beam 11 when shifted in a direction indicated by the arrow B, but does not engage the horizontal slot 35 when the beam is shifted downward into the vertical slots 34. Each beam 11 is made from an upper U-shaped piece 58 and a lower U-shaped piece 59 which are welded together adjacent the edge 60 (FIG. 16). In addition, each beam 11 may include rectangular windows 62 and circular windows 122 through the beam 11 for vertical routing of data or power lines 23, 24 through the beams 11 within the panel frame 2. Each locking wedge 12 includes an aperture 61 which is used to hang the locking wedge 12 for painting during the fabrication process.

Figure 18:
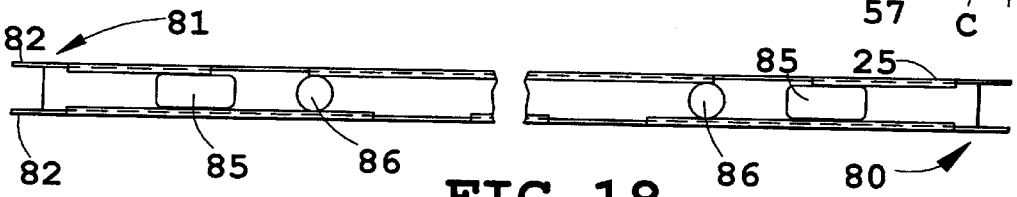
FIG. 18 is a fragmentary, top plan view of the data trough.
Figure 17:
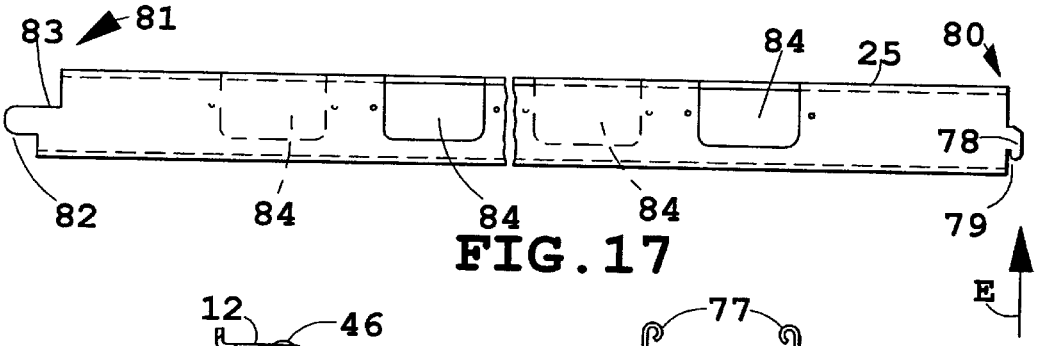
FIG. 17 is a fragmentary, front elevational view of the data trough.
Figure 19:
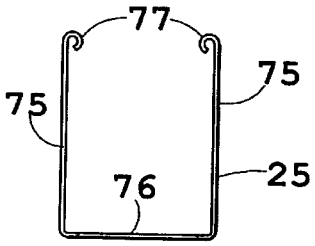
FIG. 19 is a side elevational view of the data trough.
Figure 21:
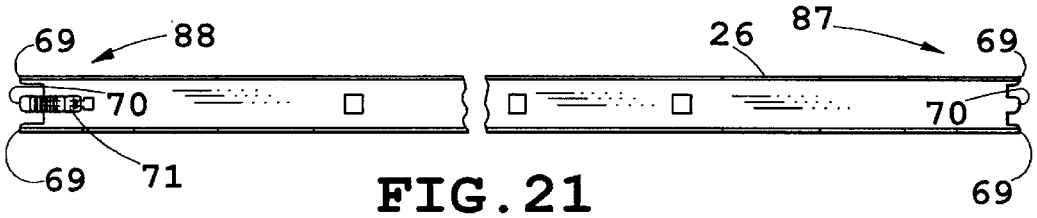
FIG. 21 is a fragmentary, top plan view of the power trough.
Figure 20:
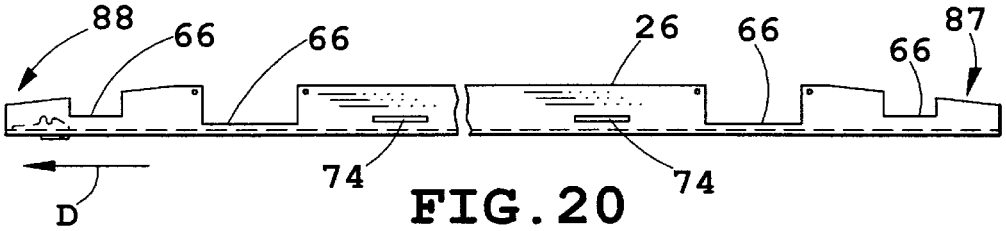
FIG. 20 is a fragmentary, front elevational view of the power trough.
Figure 22:
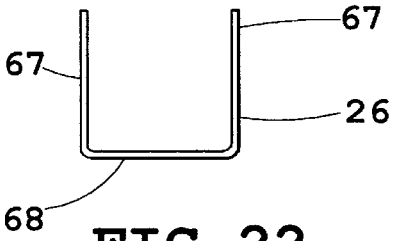
FIG. 22 is a side elevational view of the power trough.

Two types of utility troughs may be utilized for routing of data and power lines 23, 24. A data trough 25 is illustrated in FIGS. 17–19, and a power trough 26 is illustrated in FIGS. 20–22. Either trough may be used for routing of data or power lines 23, 24 within the trough; however, only the power trough 26 is utilized for hanging power boxes 63 and power lines 24 therebelow.

With reference to FIGS. 17–19, each data trough 25 has a U-shaped cross-sectional shape that includes a bottom wall 76 and side walls 75 having a curved-under top edge 77. Each data trough 25 also includes a pair of tabs 78 and a slot 79 forming a downwardly extending hook at a first end 80. At a second end 81, the data trough 25 includes a pair of tabs 82 with a cut-back portion 83 that provides clearance when the first end 80 of the data trough is tipped upward in a direction of the arrow "E" (FIG. 17) during removal and installation of the data trough 25 between a pair of posts 6 when the panel frame 2 is in an assembled condition (FIG. 3). Each of the data troughs 25 includes cut-out portions 84 for mounting of data receptacles 65, and rectangular apertures 85 and circular apertures 86 for vertical routing of data and power lines 23, 24 within the panel frame 2.

With reference to FIGS. 20–22, each power trough 26 has a generally U-shaped cross-sectional shape, and includes cut-out portions 66 along the side walls 67 for mounting data receptacles 65 (FIG. 3). Each end of the power trough 26 includes two L-shaped tabs 69 and a horizontal tab 70 (FIG. 8) which are received in the L-shaped slots 72 and the horizontal slot 73, respectively, of a utility trough port 21 (FIG. 4). One end of the power trough 26 includes a locking wedge such as sliding wedge 71 that is moved in the direction of the arrow "D" of FIG. 20 after the power trough 26 is positioned in the utility trough port 21, thereby providing a tight interference fit which prevents movement of the utility trough 26 when an electrical line is plugged into the power receptacle 64. Alternatively, a locking wedge 12 could also be utilized for attachment of the power trough 26 to the post 6. Elongated slots 74 provide a snap-in mounting for power boxes 63 as illustrated in FIG. 3.

Figure 26:
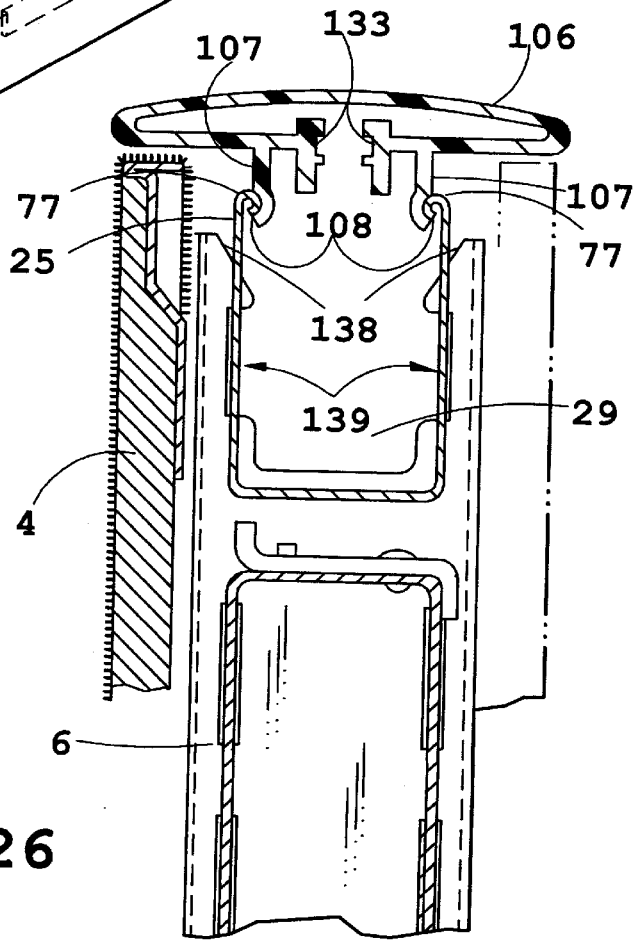
FIG. 26 is a fragmentary, side elevational view of the assembled knock-down portable partition showing the top cap installed into the data trough.

As best seen in FIG. 3, the data trough 25 may be installed by inserting the second end 81 into the utility trough port of a post 6. The first end 80 is rotated downward, the beam is then shifted in the direction of the first end 80 and down, opposite the arrow E (FIG. 17) to engage the slots 79 into the L-shaped slots 72 of the utility trough port 21. With reference to FIG. 26, each of the upper utility ports 29 include tapered upper edges 138 and vertical notch portions 139. During installation of the upper data troughs 25, the tabs 78 and 82 are pushed downward along the tapered edges 138 and snap into the vertical notch portions 139. The power troughs 26 may be installed in a similar manner by inserting the L-shaped tabs 69 and horizontal tab 70 into the corresponding L-shaped slots 72 and horizontal slot 73 of a utility trough port 21 (FIG. 8). The second end 88 is then rotated downward and the utility trough is shifted in the direction of the second end 88 to engage the L-shaped tabs 69 and the horizontal tab 70 into the corresponding L-shaped slots 72 and horizontal slot 73 of a utility trough port 21. The sliding wedge 71 is then shifted in the direction indicated by the arrow D shown in FIG. 20.

Figure 23:
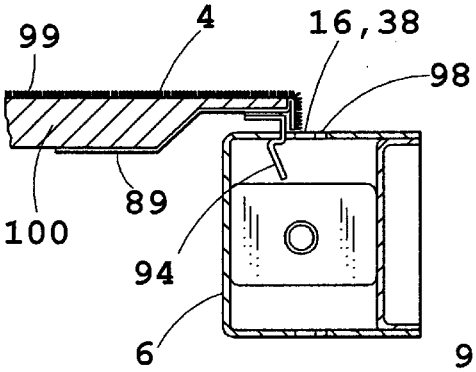
FIG. 23 is a fragmentary, top plan view of a vertical post showing the cover panel engaging the cover mounting apertures.
Figure 24:
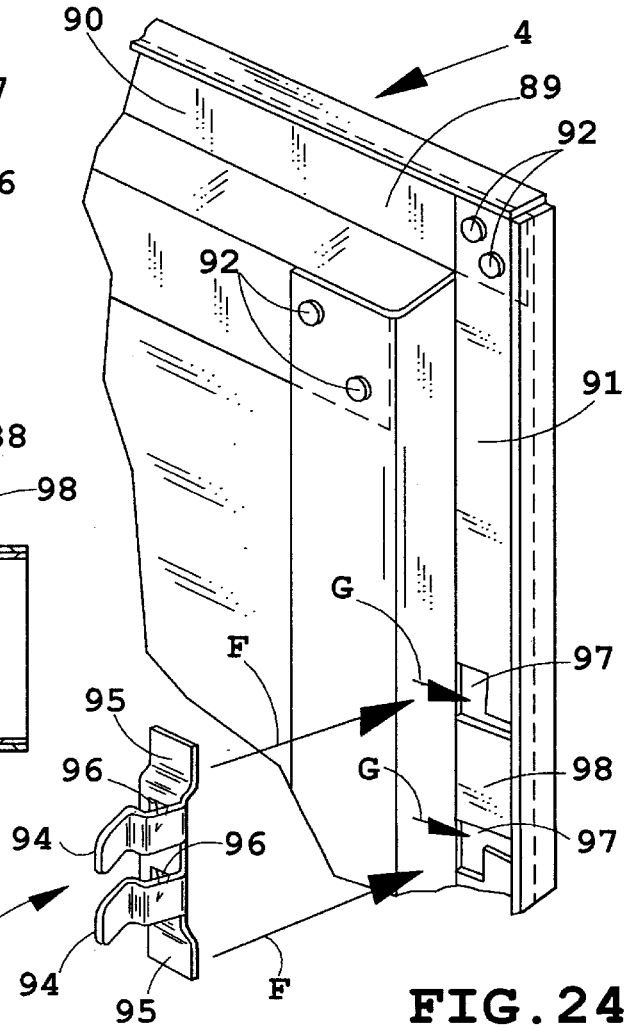
FIG. 24 is a fragmentary, perspective view of the cover panel showing the mounting of the cover retaining clips.

With reference to FIGS. 23 and 24, each cover panel 4 includes a cover frame 89 that includes horizontal numbers 90 and vertical numbers 91 that are "toggle locked" together at 92. Clips 93 include tabs 95 and spurs or bent-out portions 96, and arms 94. The clips 93 are installed to the cover frame 89 by inserting the tabs 95 into apertures 97 in the direction indicated by the arrows "F" shown in FIG. 24. The clip 93 is then slid in the direction of the arrows "G." This causes the spurs or bent-out portions 96 to engage the surface 98 between the apertures 97, thereby preventing the clip from shifting in a direction opposite the arrow G. With reference to FIGS. 4 and 23, the arms 94 of each clip 93 are received into the outer portion 98 of the apertures 38 in the vertical post 6. The apertures 38 position adjacent covers 4 in a spaced-apart relationship to provide clearance for the vertical row of slots 16. In addition, the apertures 38 provide support for the cover 4 so that the cover is held securely in position and does not shift vertically. Each cover 4 includes an outer decorative fabric layer 99 and a thicker acoustic layer 100 which may be made from a fiberglass mat or other suitable material.

Figure 25:
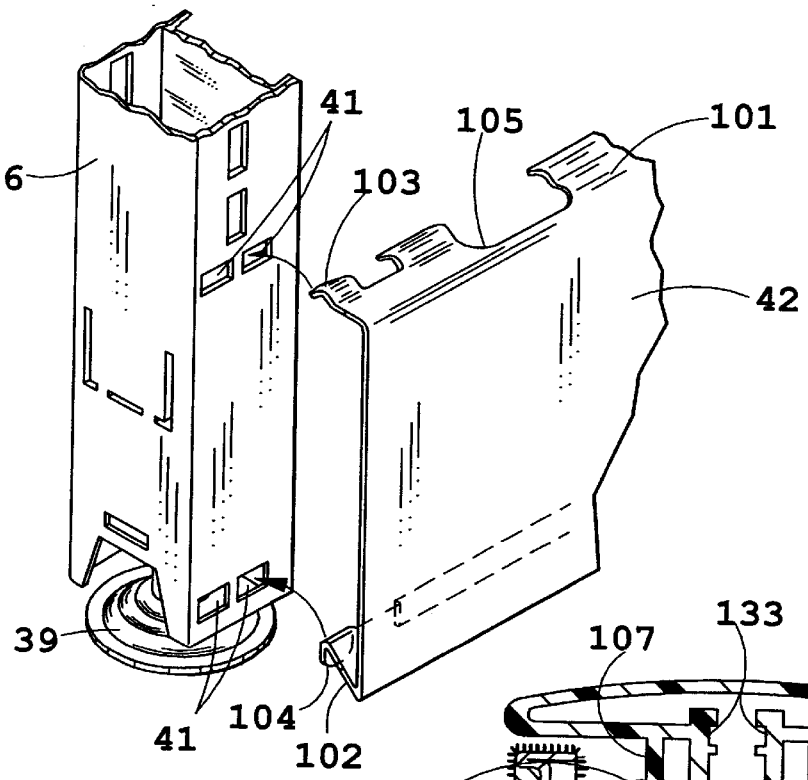
FIG. 25 is a fragmentary, perspective view showing the base cover and mounting tabs.

With reference to FIG. 25, each base cover 42 is formed from sheet metal and includes an upper flange 101 and a lower flange 102. An upper tab 103 at each end of the upper flange 101 snaps into engagement with an aperture 41, and a lower tab 104 engages an aperture 41 to retain the base cover 42 to the post 6. A cut-out 105 along the upper flange 101 provides clearance for vertical routing of data or power lines 23, 24.

With reference to FIG. 26, a top cap 106 which is molded from a polymeric material includes a pair of downwardly extending legs 107 with arcuate portions 108 which snap into the curved-under top edge 77 of a data trough 26.

Figure 27:
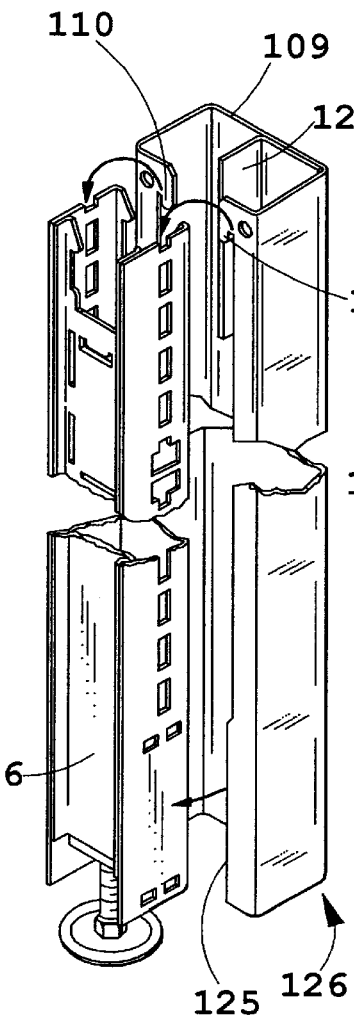
FIG. 27 is a fragmentary, perspective view showing an end cover and vertical, end-of-run post.
Figure 31A:
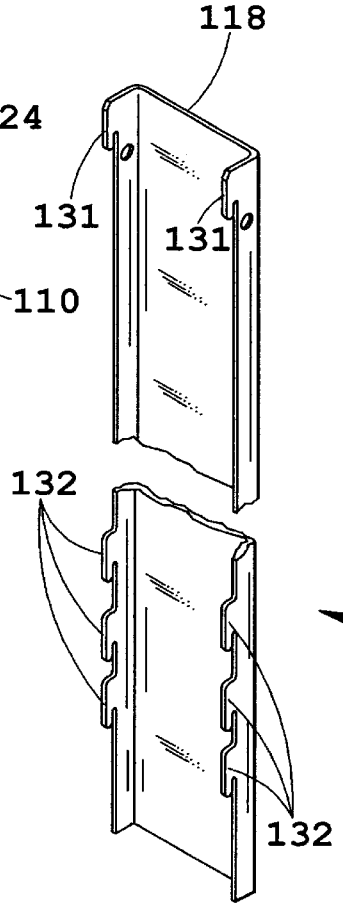
FIG. 31A is a fragmentary, perspective view of a T-cover.
Figure 28:
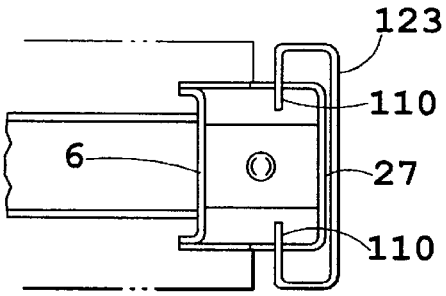
FIG. 28 is a fragmentary, top plan view of an end-of-run post with an end cover installed.
Figure 28A:
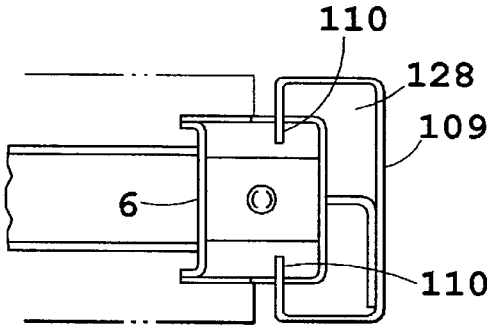
FIG. 28A is a fragmentary, top plan view of an end-of-run post with a change-of-height end cover installed.

With reference to FIGS. 27, 28 and 28A, a change-of-height end cover 109 includes slotted tabs 110 which engage the uppermost slots in a vertical row of slots 16 to provide a decorative cover for the post 6. After the slotted tabs 110 are engaged, the lower end 126 of the end cover 109 is slid over the lower end 8 of the post 6 to frictionally engage the narrow portions 125 against the post 6. The end cover 109 includes a brace 124 that offsets the end cover 109 to provide a vertical passage 128 for data and power lines 23 and 24. The end-of-run cover 123 is similar to the change-of-height end cover 109, except that the end-of-run cover 123 rests against the post 6 at the inner surface 127.

Figure 30A:
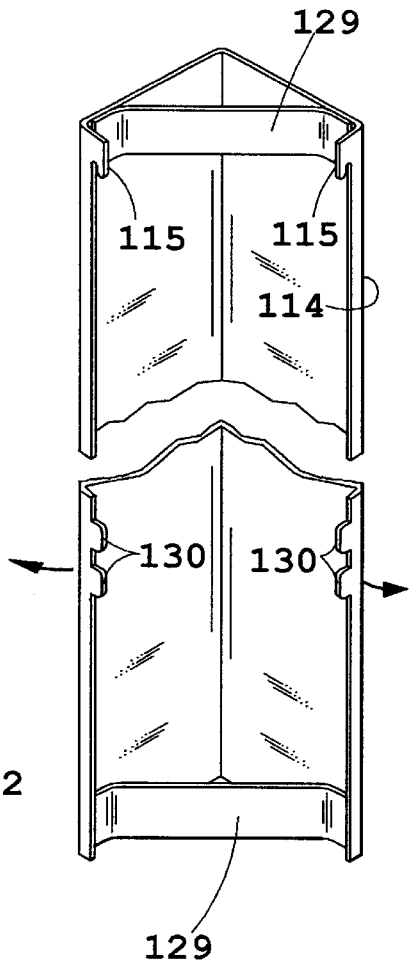
FIG. 30A is a fragmentary, perspective view of an L-cover.
Figure 27A:
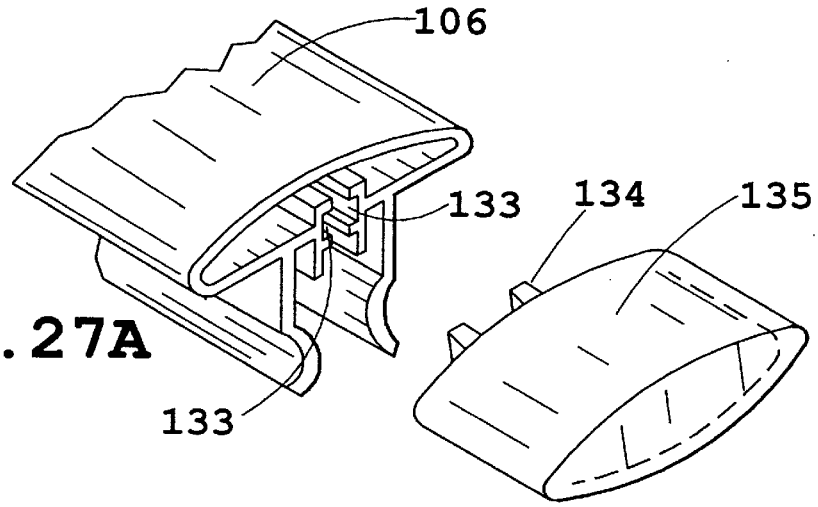
FIG. 27A is a fragmentary, perspective view of an end-of-run top cap and a top cap.
Figure 30B:
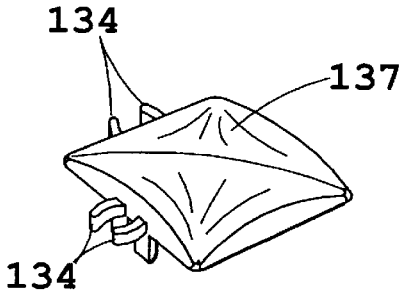
FIG. 30B is a perspective view of an L-top cap.
Figure 32:
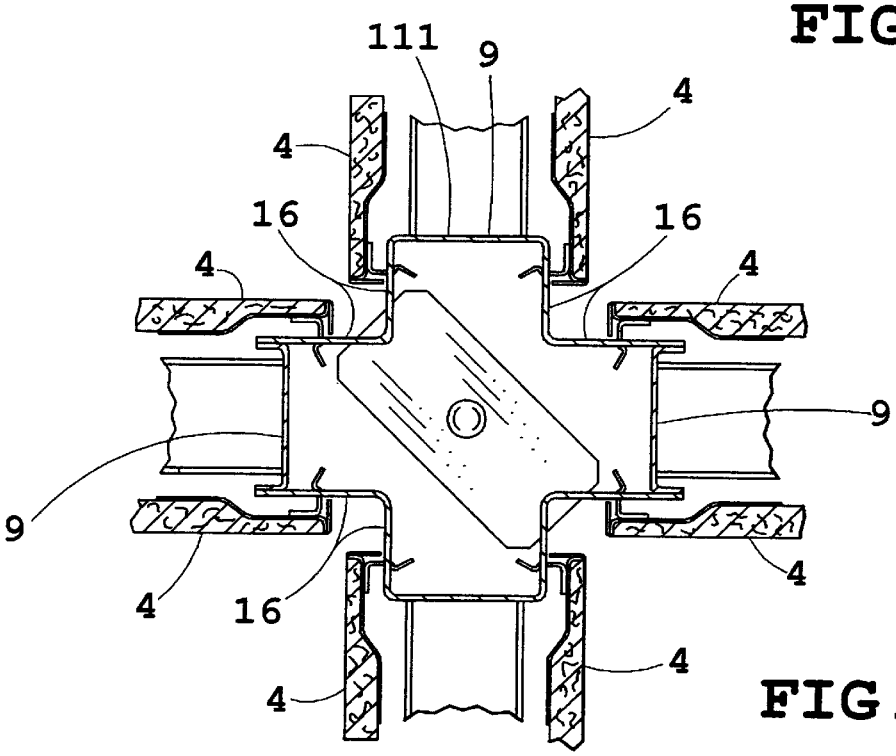
FIG. 32 is a fragmentary, top plan view of an X-post.
Figure 29:
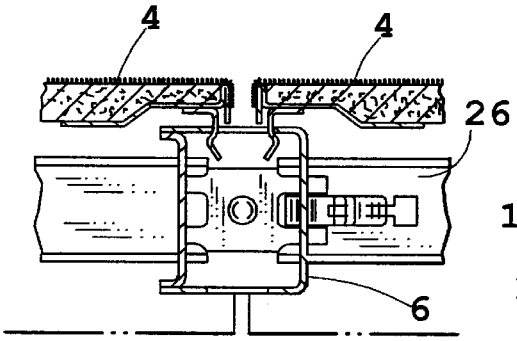
FIG. 29 is a vertical intermediate post with cover panels installed into a front face, and power troughs installed on the opposite side faces.
Figure 30:
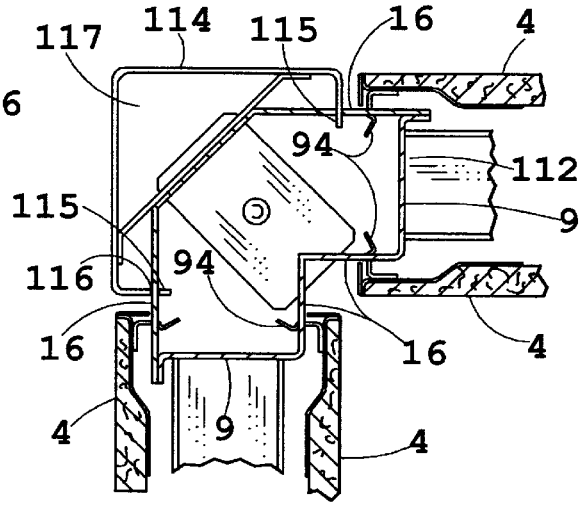
FIG. 30 is a fragmentary, top plan view of an L-post and cover.

With reference to FIGS. 29–32, the partition system 1 may include an in-line or end-of-run post 6 (FIG. 29), an L-post 112 (FIG. 30), a T-post 113 (FIG. 31), and an X-post 111 (FIG. 32). The intermediate or end-of-run post 6 may be used at an end-of-run location with an end cover 109, or at an intermediate location as illustrated in FIG. 29. With reference to FIG. 27A, an end-of-run top cap 135 is made of a polymeric material, and includes integral clips 134 which are received into the notch areas 133 of the top cap 106. The change-of-height top cap (not shown) is similar to the end-of-run top cap 135, except that it is slightly longer as required to correspond to the greater width of the change-of-height end cover 109 (FIG. 28A). With reference to FIGS. 30 and 30A, each L-post may be covered by an L-cover 114 which includes hooks 115 for engaging slots 116 in the L-post 112. Each L-cover 114 also includes smaller tabs 130 (FIG. 30A) which engage the vertical row of slots 16 to retain the lower end thereof. A brace 129 provides a rigidity at the upper and lower ends of the L-cover 114. The L-cover 114 provides an open vertical passage 117 that may be utilized for vertical routing of electrical or power lines. With reference to FIG. 30B, an L-top cap is made of a polymeric material, and includes integral clips 134 that are received into the notch areas 133 of the top cap 106 (FIG. 26). The spacing of the covers 4 and the L-cover 114 provides clearance such that hang-on binder bins or other accessories may be hung from the vertical row of slots 16.

Figure 31B:
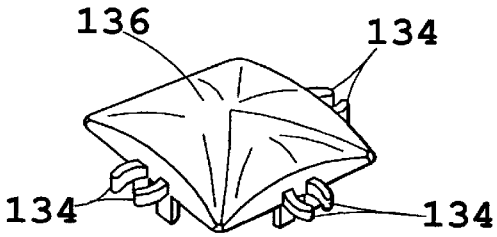
FIG. 31B is a perspective view of a T-top cap.
Figure 31:
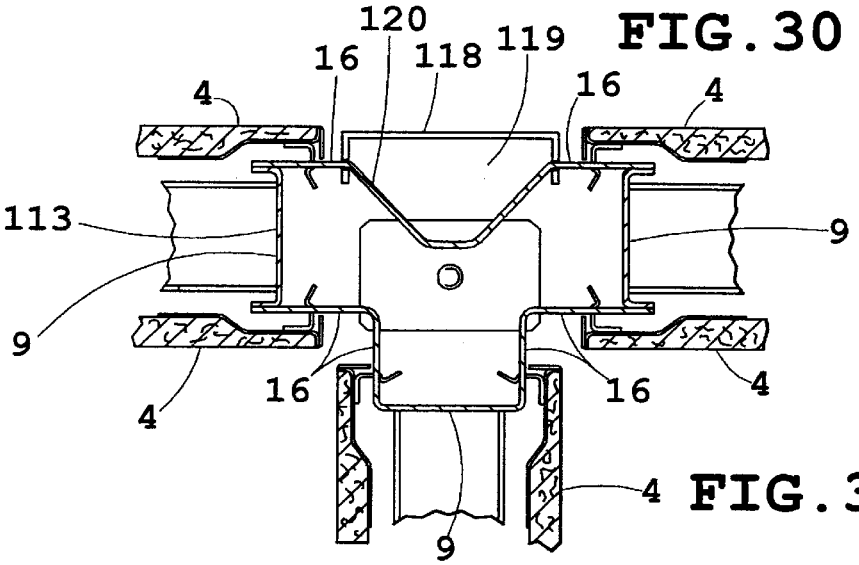
FIG. 31 is a fragmentary, top plan view of a T-post and cover.

The T-post 113 includes a recessed portion 120, which, in combination with the T-cover 118 provides a vertical passage 119 for vertical wiring of power or communications cabling (FIG. 31). The T-cover 118 includes upper hooks 131 and lower hooks 132 that engage the vertical row of slots 16. With reference to FIG. 31B, a T-top cap 136 includes integrally formed clips 134 that are received in the notch areas 133 of the top cap 106.

With reference to FIG. 32, an X-post 111 has a generally X-shaped plan configuration for joining four panel frames 2 in an X formation. All of the post configurations have a single foot 39, and also have opposite faces with a plurality of beam connection ports 10 and utility trough ports 21 in the same configuration as the in-line post 6. In addition, each of the posts include a vertical row of slots 16 for support of hang-on accessory units.

Figure 33:
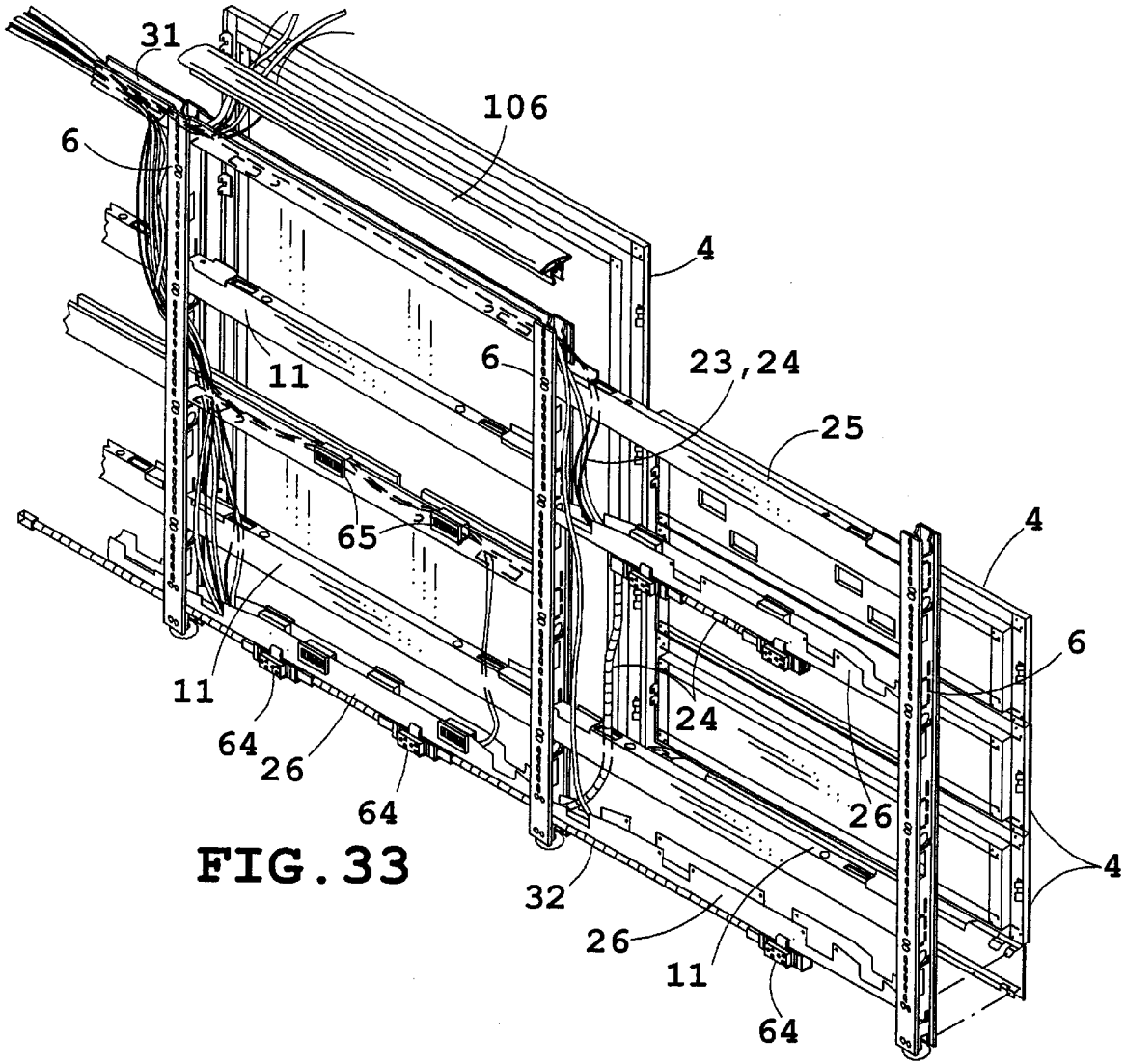
FIG. 33 is a fragmentary, exploded perspective view of the partition system showing the data and power lines and receptacles.
Figure 34:
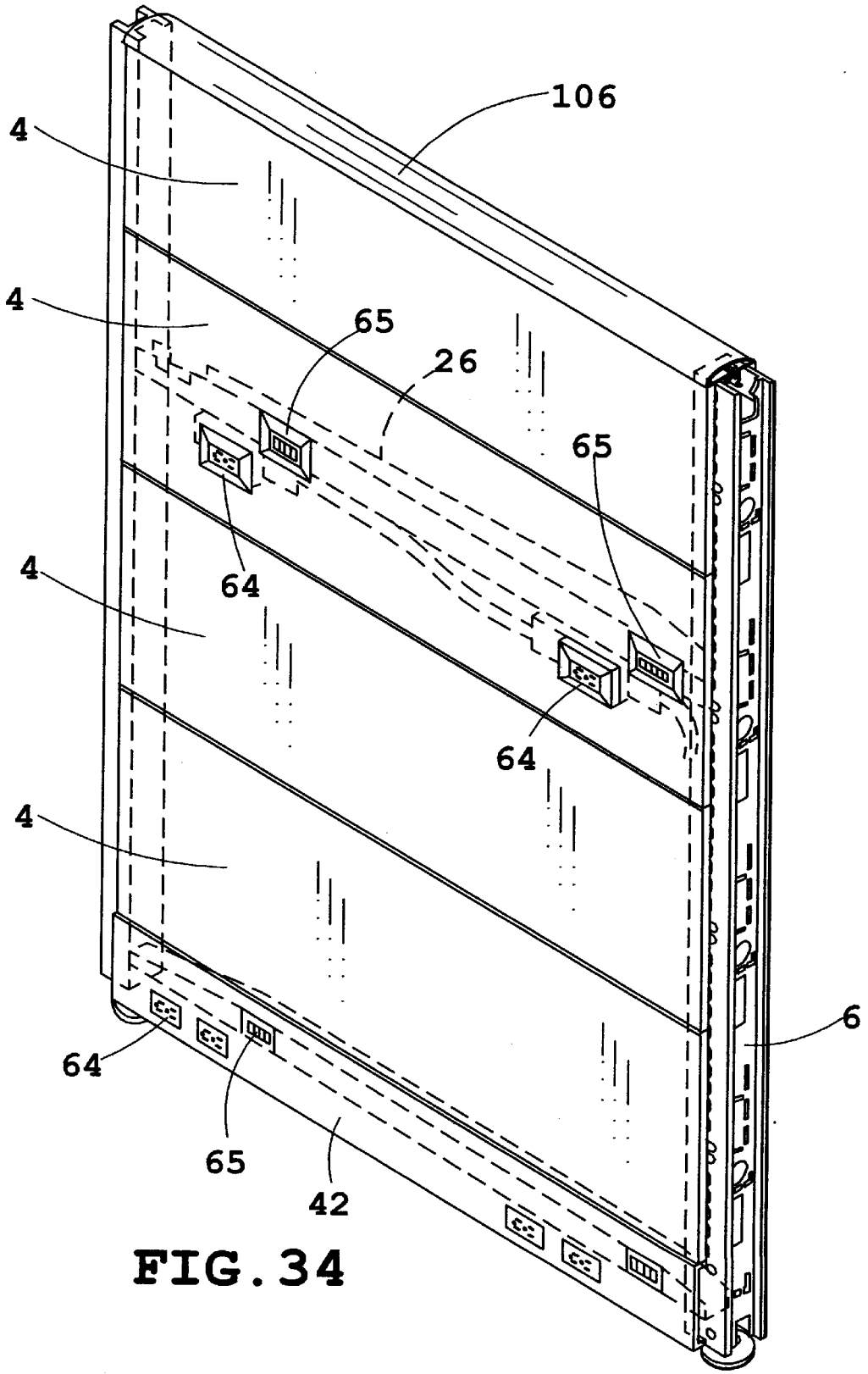
FIG. 34 is a perspective view of an individual panel section showing the data and power receptacles at the base and beltway heights.

With reference to FIG. 33, the data and power troughs 25 and 26 provide a flexible, easily installed system for support of data and power lines 23 and 24, and the power and data receptacles 64, 65. The data and power lines 23, 24 may be run vertically through the apertures in the utility troughs and beams. As illustrated in FIG. 34, a single power trough mounted at a beltway-high level may provide for both power receptacles 64 and data receptacles 65. The base covers 42 are also cut out to provide for both power and data receptacles 64, 65 at the base of the panel.

The knock-down portable partition system 1 of the present invention provides a flexible, easily shipped and assembled system having capability for handling a wide range of power and communications cabling needs. The panel frame 2 is simple, and quickly assembled yet provides sufficient structural strength for support of hang-on accessories such as binder bins 18, work surfaces 19, and lower file storage units 20. Each post utilizes a single foot for support, thereby simplifying the vertical adjustment of the panel frame 2. The beams 11 and the data and power troughs 25, 26 may all be removed from between a pair of vertical posts 6 while the adjacent panel frames 2 are in an assembled condition. The cover panels 4 are easily removed and installed and provide an acoustic, sound-absorbing layer.

It will become apparent to those skilled in the art that various modifications to the preferred embodiment of the invention as described herein can be made without departing from the spirit or scope of the invention as defined by the appended claims.

We claim:

1. A knock-down portable partition, comprising:

a rigid panel frame having a central portion;

at least one cover panel covering at least a portion of the central portion of said rigid panel frame;

connectors detachably mounting said cover panel on said rigid panel frame to facilitate assembly and removal of said cover panel on said rigid panel frame;

said rigid panel frame including:

at least two vertical posts each having an upper end, a lower end and opposite faces with at least two beam connection ports thereon positioned adjacent the upper and lower ends of the associated one of said posts;

upper and lower beams extending generally horizontally between said vertical posts adjacent the upper and lower ends thereof, and rigidly interconnecting said posts adjacent said connection ports;

movable lock wedges positioned on one of said posts and said beams adjacent said connection ports, and being movably mounted thereon for shifting between a retracted unlocked position and an extended locked position;

wedge engaging surfaces positioned on the other of said posts and said beams adjacent said connection ports, said wedges abuttingly engaging said wedge engaging surfaces in a tight interference fit as said wedges are shifted to said extended locked position and rigidly yet detachably interconnecting said posts and said beams for quick and complete assembly and disassembly of said knock-down portable partition.

2. A partition as set forth in claim 1, wherein:

at least one of said beams has opposite ends thereof connected with said posts by a slot and tab arrangement.

3. A partition as set forth in claim 2, wherein:

said lock wedges are pivotally mounted and rotate between said retracted unlocked position and said extended locked position.

4. A partition as set forth in claim 3, wherein:

said lock wedges and said wedge engaging surfaces are configured so that said lock wedges inelastically deform at least a portion of said wedge engaging surfaces to produce a tight interference fit therebetween.

5. A partition as set forth in claim 4, wherein:

said lock wedges are pivotally mounted on said beams; and said wedge engaging surfaces are positioned on said posts.

6. A partition as set forth in claim 5, wherein:

said lock wedges rotate about a vertical axis to shift said lock wedges into and out of contact with said wedge engaging surfaces.

7. A partition as set forth in claim 6, wherein:

said beam connection ports include a window through said opposite face, wherein said wedge engaging surface is formed by an edge of said window.

8. A partition as set forth in claim 7, wherein:

said beam connection ports include a first pair of apertures;

each end of said structural beams include a first pair of downwardly extending hooks that are locked into engagement with said first pair of apertures by shifting said lock wedges from said retracted unlocked position to said extended locked position.

9. partition as set forth in claim 8, wherein:

said beam connection ports include a second pair of apertures;

each end of said structural beams include a second pair of downwardly extending hooks that are locked into engagement with said second pair of apertures by shifting said lock wedges from said retracted unlocked position to said extended locked position.

10. A partition as set forth in claim 1, wherein:

said posts each include a single vertically adjustable foot for abuttingly supporting the same on a floor surface.

11. A partition as set forth in claim 10, wherein:

said posts have sufficient structural strength to support hang-on accessory units thereon, and front faces with a vertical row of slots extending along said front for hanging a hang-on accessory unit; and including a hang-on accessory unit removably attached to at least one of said vertical rows of slots of said posts.

12. A partition as set forth in claim 1, wherein:

said cover panel is non-structural and includes a layer of acoustical sound absorbing material.

13. A knock-down portable partition, comprising:

a panel frame having a central portion;

at least one cover panel covering at least a portion of the central portion of said panel frame;

connectors detachably mounting said cover panel on said panel frame to facilitate assembly and removal of said cover panel on said panel frame;

said panel frame including:

at least two vertical posts each having an upper end, a lower end and opposite faces with at least two beam connection ports thereon positioned adjacent the upper and lower ends of the associated one of said posts;

upper and lower beams extending generally horizontally between said vertical posts adjacent the upper and lower ends thereof, and interconnecting said posts adjacent said connection ports;

movable lock wedges positioned on said beams adjacent said connection ports, and being pivotally mounted thereon and rotating between a retracted unlocked position and an extended locked position;

wedge engaging surfaces positioned on said posts adjacent said connection ports, and being located thereon to engage said wedges in a tight interference fit when said wedges are shifted to said extended locked position to rigidly yet detachably interconnect said posts and said beams for quick and complete assembly and disassembly of said knock-down portable partition;

at least one of said beams having opposite ends thereof connected with said posts by a slot and tab arrangement;

said lock wedges and said wedge engaging surfaces configured so that said lock wedges inelastically deform at least a portion of said wedge engaging surfaces to produce a tight interference fit therebetween;

said beam connection ports including a window through said opposite face, wherein said wedge engaging surface is formed by an edge of said window; and said wedge engaging surfaces tapered such that said wedge engaging surfaces are progressively inelastically deformed by shifting of said lock wedges from said retracted unlocked position to said extended locked position.

14. A knock-down portable partition, comprising:

a panel frame having a central portion;

at least one cover panel covering at least a portion of the central portion of said panel frame;

connectors detachably mounting said cover panel on said panel frame to facilitate assembly and removal of said cover panel on said panel frame;

said panel frame including:

at least two vertical posts each having an upper end, a lower end and opposite faces with at least two beam connection ports thereon positioned adjacent the upper and lower ends of the associated one of said posts;

upper and lower beams extending generally horizontally between said vertical posts adjacent the upper and lower ends thereof, and interconnecting said posts adjacent said connection ports;

movable lock wedges positioned on said beams adjacent said connection ports, and being pivotally mounted thereon and rotating between a retracted unlocked position and an extended locked position;

wedge engaging surfaces positioned on said posts adjacent said connection ports, and being located thereon to engage said wedges in a tight interference fit when said wedges are shifted to said extended locked position to rigidly yet detachably interconnect said posts and said beams for quick and complete assembly and disassembly of said knock-down portable partition;

said lock wedges and said wedge engaging surfaces configured so that said lock wedges inelastically deform at least a portion of said wedge engaging surfaces to produce a tight interference fit therebetween;

said beam connection ports including a window through said opposite face, wherein said wedge engaging surface is formed by an edge of said window;

said beam connection ports including first and second pairs of apertures;

each end of said structural beams including first and second pairs of downwardly extending hooks that are locked into engagement with said first and second pairs of apertures by shifting said lock wedges from said retracted unlocked position to said extended locked position;

said beams have a top surface; and said lock wedges are positioned on said top surface and generate a downward force on said beams upon engagement of said lock wedges with said wedge engaging surfaces to lock said hooks into engagement with said first pair of apertures.

15. A partition as set forth in claim 14, wherein:

said lock wedges include a lever arm for mechanical advantage whereby said lock wedges can be manually shifted from said retracted unlocked position to said extended locked position by a person without the use of tools.

16. A partition as set forth in claim 15, wherein:

said beams have a tubular cross-sectional shape defining top and bottom faces, said top and bottom faces having apertures for passing data and power cabling therethrough.

17. A partition as set forth in claim 16, wherein:

said posts have a tubular quadrilateral cross-sectional shape.

18. A partition as set forth in claim 17, wherein:

said posts each have a plurality of utility trough ports with associated windows through said posts for passing utility conduits therethrough; and at least one utility trough shaped to receive and retain utility conduits therein, and having opposite ends thereof configured to be detachably connected with a horizontally aligned pair of said utility trough ports on said posts.

19. A partition as set forth in claim 18, wherein:

said utility troughs are removable when said panel frame is in said assembled condition.

20. A partition as set forth in claim 19, wherein:

said posts each include a pair of horizontally aligned upper utility trough ports on said opposite side faces adjacent said upper end above said upper beam and a pair of horizontally aligned lower utility trough ports on said opposite side faces adjacent said lower end below said lower structural beam.

21. A partition as set forth in claim 20, wherein:

said panel frame defines a top edge; and said utility trough ports adjacent said upper end include windows having an open upper side for lay-in of utility conduits along said top edge of said panel frame.

22. A partition as set forth in claim 21, wherein:

said panel frame defines a bottom edge; and said utility trough ports adjacent said lower end include windows having an open lower side for lay-in of utility conduits along said bottom edge.

23. A partition as set forth in claim 18, wherein:

said utility trough forms a power trough; and said panel frame includes:

movable lock wedges positioned on one of said posts and said power trough adjacent said utility trough connection ports, and being movably mounted thereon for shifting between a retracted unlocked position and an extended locked position;

wedge engaging surfaces positioned on the other of said posts and said power trough adjacent said utility trough ports, and being located thereon to engage said wedges in a tight interference fit when said wedges are shifted to said extended locked position to rigidly yet detachably interconnect said posts and said power trough for quick assembly and disassembly thereof.

24. A partition as set forth in claim 23, wherein:

said power trough has a lower surface and a connector for hanging a power block adjacent said lower surface.

25. A partition as set forth in claim 24, wherein said power trough has a generally U-shaped cross-sectional shape which extends substantially uninterrupted between said posts.

26. A partition as set forth in claim 25, wherein:

said power trough is below said lower beam.

27. A partition as set forth in claim 18, wherein:

said at least one utility trough forms a data trough having opposite ends thereof configured to be detachably connected with a horizontally aligned pair of said utility trough ports on said posts when said panel frame is in said assembled condition, said data trough having each end thereof positioned in horizontal alignment with the windows on said pair of utility trough ports.

28. A partition as set forth in claim 27, wherein:

said data trough includes vertically oriented notches at an end thereof that engage an adjacent edge of the associated port window to longitudinally lock said utility trough in said panel frame.

29. A partition as set forth in claim 28, wherein:

said data trough has an inverted U-shaped configuration which extends substantially uninterrupted between said posts.

30. A partition as set forth in claim 24, wherein:

said utility trough ports include horizontally oriented slots adjacent said windows; and said data trough includes a horizontally oriented tab that engages said horizontally oriented slot.

31. A partition as set forth in claim 22, wherein:

said beams are removable from between an assembled pair of said panel frames.

32. A knock-down portable partition, comprising:

a panel frame having a central portion;

at least one cover panel covering at least a portion of the central portion of said panel frame;

connectors detachably mounting said cover panel on said panel frame to facilitate assembly and removal of said cover panel on said panel frame;

said panel frame including:

at least two vertical posts each having an upper end, a lower end and opposite faces with at least two beam connection ports thereon positioned adjacent the upper and lower ends of the associated one of said posts;

upper and lower beams extending generally horizontally between said vertical posts adjacent the upper and lower ends thereof, and interconnecting said posts adjacent said connection ports;

movable lock wedges positioned on one of said posts and said beams adjacent said connection ports, and being movably mounted thereon for shifting between a retracted unlocked position and an extended locked position;

wedge engaging surfaces positioned on the other of said posts and said beams adjacent said connection ports, and being located thereon to engage said wedges in a tight interference fit when said wedges are shifted to said extended locked position to rigidly yet detachably interconnect said posts and said beams for quick and complete assembly and disassembly of said knock-down portable partition;

said posts each including a single vertically adjustable foot for abuttingly supporting said posts on a floor surface;

said posts having sufficient structural strength to support hang-on accessory units thereon, and front faces with a vertical row of slots extending along said front for hanging a hang-on accessory unit;

a hang-on accessory unit removably attached to at least one of said vertical rows of slots of said posts; and at least one of said posts having a generally L-shaped top plan configuration for orienting adjacent panel framers in an angular relationship.

33. A knock-down portable partition, comprising:

a panel frame having a central portion;

at least one cover panel covering at least a portion of the central portion of said panel frame;

connectors detachably mounting said cover panel on said panel frame to facilitate assembly and removal of said cover panel on said panel frame;

said panel frame including:

at least two vertical posts each having an upper end, a lower end and opposite faces with at least two beam connection ports thereon positioned adjacent the upper and lower ends of the associated one of said posts;

upper and lower beams extending generally horizontally between said vertical posts adjacent the upper and lower ends thereof, and interconnecting said posts adjacent said connection ports;

movable lock wedges positioned on one of said posts and said beams adjacent said connection ports, and being movably mounted thereon for shifting between a retracted unlocked position and an extended locked position;

wedge engaging surfaces positioned on the other of said posts and said beams adjacent said connection ports, and being located thereon to engage said wedges in a tight interference fit when said wedges are shifted to said extended locked position to rigidly yet detachably interconnect said posts and said beams for quick and complete assembly and disassembly of said knock-down portable partition;

said posts each including a single vertically adjustable foot for abuttingly supporting said posts on a floor surface;

said posts having sufficient structural strength to support hang-on accessory units thereon, and front faces with a vertical row of slots extending along said front for hanging a hang-on accessory unit;

a hang-on accessory unit removably attached to at least one of said vertical rows of slots of said posts; and at least one of said post having a generally X-shaped top plan configuration for orienting adjacent panel frames in an angular relationship.

34. A knock-down portable partition, comprising:

a panel frame having a central portion;

at least one cover panel covering at least a portion of the central portion of said panel frame;

connectors detachably mounting said cover panel on said panel frame to facilitate assembly and removal of said cover panel on said panel frame;

said panel frame including:

at least two vertical posts each having an upper end, a lower end and opposite faces with at least two beam connection ports thereon positioned adjacent the upper and lower ends of the associated one of said posts;

upper and lower beams extending generally horizontally between said vertical posts adjacent the upper and lower ends thereof, and interconnecting said posts adjacent said connection ports;

movable lock wedges positioned on one of said posts and said beams adjacent said connection ports, and being movably mounted thereon for shifting between a retracted unlocked position and an extended locked position;

wedge engaging surfaces positioned on the other of said posts and said beams adjacent said connection ports, and being located thereon to engage said wedges in a tight interference fit when said wedges are shifted to said extended locked position to rigidly yet detachably interconnect said posts and said beams for quick and complete assembly and disassembly of said knock-down portable partition;

said posts each including a single vertically adjustable foot for abuttingly supporting said posts on a floor surface;

said posts having sufficient structural strength to support hang-on accessory units thereon, and front faces with a vertical row of slots extending along said front for hanging a hang-on accessory unit;

a hang-on accessory unit removably attached to at least one of said vertical rows of slots of said posts; and at least one of said posts having a generally T-shaped top plan configuration for orienting adjacent panel frames in an angular relationship.

35. In a portable partition system, the improvement of a rigid knock-down frame construction, comprising:

at least two vertical posts each having an upper end, a lower end and opposite faces with at least two beam connection ports thereon positioned adjacent the upper and lower ends of the associated one of said posts;

upper and lower beams extending generally horizontally between said vertical posts adjacent the upper and lower ends thereof, and rigidly interconnecting the same adjacent said connection ports;

movable lock wedges positioned on one of said posts and said beams adjacent said connection ports, and being movably mounted thereon for shifting between a retracted unlocked position and an extended locked position;

wedge engaging surfaces positioned on the other of said posts and said beams adjacent said connection ports, said wedges abuttingly engaging said wedge engaging surfaces in a tight interference fit as said wedges are shifted to said extended locked position to rigidly yet detachably interconnect said posts and said beams for quick and complete assembly and disassembly of said knock-down portable partition.

36. A partition system as set forth in claim 35, wherein:

at least one of said beams has opposite ends thereof connected with said posts by a slot and tab arrangement.

37. A partition system as set forth in claim 35, wherein:

said lock wedges are pivotally mounted and rotate between said retracted unlocked position and said extended locked position.

38. A partition system as set forth in claim 35, wherein:

said lock wedges and said wedge engaging surfaces are configured so that said lock wedges inelastically deform at least a portion of said wedge engaging surfaces to produce a tight interference fit therebetween.

39. A partition system as set forth in claim 35, wherein:

said frame has a central portion and includes connectors for detachably mounting a cover panel that covers at least a portion of said central portion.

40. In a portable partition system, the improvement of a quick-disconnect frame connection system, comprising:

at least one post;

at least one beam;

at least one connection port positioned between said post and said beam;

at least one movable lock wedge positioned on one of said post and said beam adjacent said connection port, and being movably mounted thereon for shifting between a retracted unlocked position and an extended locked position; and at least one wedge engaging surface positioned on the other of said post and said beam adjacent said connection ports, and being abuttingly engaged and inelastically deformed by said wedge as said wedge is shifted to said extended locked position and creating a tight interference fit and rigidly yet detachably interconnecting said post and said beam.

41. A partition system as set forth in claim 40, wherein:

said lock wedge is pivotally mounted and rotates between said retracted unlocked position and said extended locked position.

42. A partition system as set forth in claim 41, wherein:

said lock wedge is pivotally mounted on said beam; and said wedge engaging surface is positioned on said post.

43. A partition system as set forth in claim 42, wherein:

said beam has an opposite end thereof connected with said post by a slot and tab arrangement.

44. A partition system as set forth in claim 43, wherein:

said beam connection port includes a first pair of apertures;

each end of said structural beam includes a first pair of downwardly extending hooks that are locked into engagement with said first pair of apertures by shifting said lock wedge from said retracted unlocked position to said extended locked position.

45. A partition system as set forth in claim 44, wherein:

said beam-connection port includes a second pair of apertures;

each end of said structural beam includes a second pair of downwardly extending hooks that are locked into engagement with said second pair of apertures by shifting said lock wedge from said retracted unlocked position to said extended locked position.

46. A partition system as set forth in claim 40, wherein:

said post has a plurality of utility trough ports with associated windows through said post for passing utility conduits therethrough; and including:

at least one utility trough shaped to receive and retain utility conduits therein, and having opposite ends thereof configured to be detachably connected with said utility trough ports on said post.

47. A partition system as set forth in claim 46, wherein said utility trough has a generally U-shaped cross-sectional shape with a smaller U-shaped extension defining said lower surface which extends substantially uninterrupted between said posts.

48. A partition system as set forth in claim 46, wherein:

said utility trough forms a power trough having provisions for mounting an electrical receptacle.

49. A partition system as set forth in claim 40, wherein:

said partition system includes a panel frame; said partition system including:

at least one cover panel configured to enclose at least a portion of the open interior of said panel frame, and being removably mounted on said panel frame to readily access the open interior thereof.

50. A partition system as set forth in claim 40, wherein:

each of said posts has a single vertically adjustable foot for abuttingly supporting said post on a floor surface.

51. In a portable partition system, the improvement of a quick-disconnect frame connection system, comprising:

at least one post;

at least one beam;

at least one connection port positioned between said post and said beam;

at least one movable lock wedge pivotally mounted on said beam adjacent said connection port, and rotating between a retracted unlocked position and an extended locked position;

at least one wedge engaging surface positioned on said post adjacent said connection port, and being located thereon to be engaged and inelastically deformed by said wedge when said wedge is shifted to said extended locked position to create a tight interference fit which rigidly yet detachably interconnects said post and said beam;

said beam connection port including first and second pairs of apertures;

each end of said structural beam including first and second pairs of downwardly extending hooks that are locked into engagement with said first and second pairs of apertures by shifting said lock wedge from said retracted unlocked position to said extended locked position;

said beam has a top surface; and said lock wedge is positioned on said top surface and generates a downward force on said beam to lock said hooks into engagement with said first pair of apertures.

52. A partition system as set forth in claim 51, wherein:

said lock wedge includes a lever arm for mechanical advantage whereby said lock wedge can be shifted from said retracted unlocked position to said extended locked position.

* * * * *

UNITED STATES PATENT AND TRADEMARK OFFICE

CERTIFICATE OF CORRECTION

PATENT NO. : 5,899,035
DATED : May 4, 1999
INVENTOR(S) : Waalkes et al.

It is certified that error appears in the above-identified patent and that said Letters Patent is hereby corrected as shown below:

ON THE TITLE PAGE:

U.S. PATENT DOCUMENTS insert --3,462,872 Meyer 4,470,232 Condevaux 5,209,035 Hodges 5,487,246 Hodges 5,511,349 Kelley--

Assignee:

"Steelcase, Inc." should be --Steelcase Inc.--.

Col. 7, line 35

"include" should be --includes--;

UNITED STATES PATENT AND TRADEMARK OFFICE

CERTIFICATE OF CORRECTION

PATENT NO. : 5,899,035
DATED : May 4, 1999
INVENTOR(S) : Waalkes et al.

It is certified that error appears in the above-identified patent and that said Letters Patent is hereby corrected as shown below:

Col. 8, line 13:

After "used" insert --to--;

Col. 15, line 3:

Before "sliding" delete "the";

Signed and Sealed this

Twenty-eighth Day of December, 1999

*Attest:*

*Attesting Officer*

Q. TODD DICKINSON

*Acting Commissioner of Patents and Trademarks*